US006671977B2

(12) United States Patent
Beaumont

(10) Patent No.: US 6,671,977 B2
(45) Date of Patent: Jan. 6, 2004

(54) APPLIANCE ATTACHABLE TO A DRYER AND A DRYER FOR USE THEREWITH

(75) Inventor: Bart Donald Beaumont, Mississauga (CA)

(73) Assignee: Boemar Inc., Road Town Tortola (VG)

( * ) Notice: Subject to any disclaimer, the term of this patent is extended or adjusted under 35 U.S.C. 154(b) by 0 days.

(21) Appl. No.: 09/902,791

(22) Filed: Jul. 12, 2001

(65) Prior Publication Data

US 2002/0023368 A1 Feb. 28, 2002

Related U.S. Application Data

(60) Provisional application No. 60/218,079, filed on Jul. 12, 2000.

(51) Int. Cl.[7] ..... F26B 21/06

(52) U.S. Cl. ..... 34/79; 34/82; 34/553; 34/554; 34/84; 34/90

(58) Field of Search ..... 34/329, 331, 333, 34/337, 356, 357, 397, 60, 83, 84, 221, 218, 90, 79, 82, 553, 554

(56) References Cited

U.S. PATENT DOCUMENTS

| | | | | |
|---|---|---|---|---|
| 2,577,104 A | | 12/1951 | Butler | |
| 2,825,148 A | * | 3/1958 | Olson | 34/75 |
| 2,959,044 A | * | 11/1960 | Stone | 68/12 |
| 3,081,554 A | | 3/1963 | Long | |
| 3,639,998 A | | 2/1972 | Mason | |
| 4,115,485 A | * | 9/1978 | Genessi | |
| 4,689,896 A | | 9/1987 | Narang | |
| 4,969,276 A | | 11/1990 | Walsh | |
| 5,097,606 A | | 3/1992 | Harmelink et al. | |
| 5,272,781 A | | 12/1993 | Bastin et al. | |
| 5,443,541 A | * | 8/1995 | St. Louis | 34/486 |
| 5,560,124 A | | 10/1996 | Hart et al. | |
| 5,628,122 A | | 5/1997 | Spinardi | |
| 5,706,588 A | | 1/1998 | Dausch et al. | |
| 6,220,092 B1 | | 4/2001 | Catbagan | |

FOREIGN PATENT DOCUMENTS

| | | |
|---|---|---|
| CA | 461915 | 12/1949 |
| CA | 1158930 | 12/1983 |
| CA | 20244870 | 12/1993 |
| DE | 3930727 | 3/1991 |
| EP | 0312072 | 4/1989 |

* cited by examiner

*Primary Examiner*—K. B. Rinehart
(74) *Attorney, Agent, or Firm*—Nancy E. Hill; Hill & Schumacher

(57) ABSTRACT

A lint collector and safety system for the clothes dryer. The lint collector removes lint. The safety system determines whether the flow of exhaust air is above a pre-set level, and causes an interruption of electrical power to the clothes dryer if there is not. The invention provides for more efficient drying of clothes and reduces risk of fires. The system may also include an interruption of electrical power for other malfunctions of clothes dryer.

30 Claims, 17 Drawing Sheets

APPLIANCE ATTACHABLE TO A DRYER AND A DRYER FOR USE THEREWITH

CROSS REFERENCE TO RELATED PATENT APPLICATION

This patent application relates to U.S. Provisional Patent Application Serial No. 60/218,079 filed on Jul. 12, 2000 entitled SAFETY DEVICE FOR EXHAUST OF CLOTHES DRYER which is incorporated herein by reference.

FIELD OF THE INVENTION

The present invention relates to an appliance and a safety device for a clothes dryer, and especially to a lint collector and safety system for the exhaust of a clothes dryer. In particular, the collector and safety system is adapted to be attached to a clothes dryer and for example in the absence of an adequate flow of exhaust air from the dryer, the system interrupts the electrical power to the dryer until such time as an adequate flow is available. In addition the safety system may interrupt the electrical power to the dryer for other dryer malfunctions.

BACKGROUND OF THE INVENTION

Domestic clothes dryers typically have a chamber into which the wet clothes are placed for drying. Heated moist air is exhausted from the drying chamber through a screen that is intended to collect lint from the clothes. The exhaust air then typically passes through a duct that runs from the dryer to the exterior wall of the building so that the heated moist air is exhausted to the exterior of the building. The exhaust of the duct usually has a screen or flap that is intended to prevent rodents from entering the duct pipe. In practice, the screen at the dryer rapidly becomes covered in a layer of lint, and should be removed and cleaned, after or before every load that is dried. In many instances the screen is cleaned less frequently. Moreover, the screen at the dryer is not 100% effective in removing lint from the exhaust air, and further lint collects in the duct and especially at any screen located at the exterior of the building or elsewhere in the duct work. In addition, cleaning of the screen will often cause lint to fall into the duct and thus increase the lint clogging the duct work in the building.

In multi dwelling buildings typically an additional lint trap of very fine screen is installed down stream from the dryer lint trap. The term multi dwelling building is meant to cover both residential and commercial buildings that have clothes dryers including apartments, condominiums, hospitals, nursing homes, cleaners and the like. This lint screen is often located in a place that is awkward to reach and difficult to clean. The screen inevitably clogs up very quickly with lint and for safety reasons should be cleaned after every use. As a result of difficulties in reaching and cleaning the screen, people frequently remove and dispose of the lint trap screen. This has the effect of permitting lint to pass into the duct and collect in the duct and/or at an in-line booster fan that is typically located in the exhaust ducting and required by law in some jurisdictions. If the fine screen is removed, the blades on the booster fan will become gummed up with lint, which restricts circulation of exhaust air through the duct, creates a back pressure and lint build-up in the dryer and duct, and ultimately could result in a fire.

The build-up of back pressure in clothes dryers results in increased energy costs in order to dry the same load of clothes. Dryer time inevitably increases in relation to the amount of lint build up on the lint screen and in the duct work. An increase in drying time to as much as double that of the optimum drying times can increase by four to five times if the lint screen is cleaned infrequently.

In multi dwellings buildings, dryer ducting and in-line boost fans need to be cleaned at least once a year, even when the dryer lint screen and the in-line lint trap are used properly. Similarly, the screen and ducts at the exterior of a home needs to be cleaned with the same frequency.

Lint inevitably carries germs and viruses. When the lint trap screen becomes blocked, lint is forced out of the ducting system through any existing joints that are not adequately sealed. Consequently, lint particles leak out and spread through the air in the residence, carrying with them germs and viruses. Also when the lint screen is cleaned lint particles will typically be released into the home or multi dwelling building.

Fires can be caused by inadequate cleaning of dryers, lint screens and ducts in the dryer exhaust systems. The fires can be caused by overheating of fans or heating systems of the dryer and are spread by the lint in the dryer, in the duct and on the fan blades.

Systems to intercept lint in the dryer exhaust system are known. For example, the lint interceptor described in U.S. Pat. No. 4,115,485 is free of filters, screens or the like, to eliminate overheating of the associated dryer due to increased back pressure caused by clogging of screens or filters. The air from the lint interceptor is exhausted directly into the room, which eliminates further sources of back pressure.

U.S. Pat. No. 5,628,122 describes a lint remover that utilizes the water discharge of a clothes washer.

U.S. Pat. No. 2,577,104 describes a dryer safety control that has a counterweighted vane with electrical contacts, in which the vane on reduction of air flow closes the electrical contacts. Such a control would be very susceptible to deposits of lint on the electrical contacts and/or vane.

U.S. Pat. No. 3,639,998 utilizes a fan that would be susceptible to deposits of lint, and measures pressure drop across a screen.

A lint collector and safety system for the exhaust of a clothes dryer would be very useful, especially in reducing the likelihood of fires, and consequent injury or death of occupants of the house or multi dwelling buildings, as well as for more efficient drying of clothes.

SUMMARY OF THE INVENTION

A lint collector and safety system that is adaptable to a variety of situations has now been found.

Accordingly, one aspect of the present invention provides a lint collector and safety system for the exhaust of a clothes dryer, comprising: a housing, said housing having an inlet and an outlet in an upper surface of the housing for passage of exhaust air from the dryer, said inlet being adapted for attachment to the dryer, said housing having a water reservoir, said inlet being disposed such that exhaust air from the dryer is directed into the surface of water in the water reservoir, said outlet have a flow meter therein, said flow meter being adapted to cause an interruption in the electical circuit of the dryer if flow of exhaust air decreases below a pre-determined limit.

Another aspect of the present invention provides a safety system for a clothes dryer, said dryer having an outlet pipe for conveying of exhaust air from the dryer, said outlet pipe having a flow meter therein, said flow meter being adapted to cause a break in the electrical circuit of the dryer if the flow of exhaust air decreases below a pre-determined limit. The safety system may include an electrical field which "electrocutes" lint that passes therethrough. The safety system with the electrical field may be housed inside the dryer.

A further aspect of the present invention provides a clothes dryer comprising: a chamber to receive and retain clothes to be dried; an air inlet to said chamber, said air inlet having means to heat air entering the chamber through said air inlet; an air outlet to said chamber, said air outlet having a fan therein for withdrawal of air from the chamber, means to feed air from said fan to a lint collector system, said lint collector system having a housing with an inlet, an outlet and a water reservoir, said inlet being disposed such that air is fed from the fan into the water reservoir and then to said outlet.

Yet another aspect of the invention provides in a clothes dryer having a chamber to receive and retain clothes to be dried, an air inlet to said chamber with means to heat air entering the chamber through said air inlet to a predetermined temperature, means to control said clothes dryer, an air outlet to said chamber, a lint screen in said outlet and a fan for withdrawal of air from the chamber through said lint screen, the improvement comprising replacing said lint screen with a exterior lint collector system having a housing with an inlet, an outlet and a water reservoir, said lint collector system being located such that air withdrawn from the chamber by the fan is passed from the fan through the inlet of the lint collector system and directed onto water in the water reservoir.

A further aspect of the invention provides an electrical socket for receiving a dryer plug and a connection to a safety system. The electrical socket includes a socket for providing power to the dryer plug; a connection to the safety system for providing power to the safety system and for receiving signals from the safety system; and a method for interrupting power to the dryer response to predetermined signals from the safety system. The predetermined signal may be responsive to air flow dropping below a predetermined level, time or use being above a predetermined time, temperature being above a predetermined limit or the water in the safety system being below a predetermined level.

Further features of the invention will be described or will become apparent in the course of the following detailed description.

BRIEF DESCRIPTION OF THE DRAWINGS

The present invention is illustrated by the embodiments shown in the drawings, in which.

DETAILED DESCRIPTION OF THE INVENTION

The present invention relates to an appliance and safety system for a clothes dryer. In particular, the appliance includes, in sequence, a lint collector system and a system to interrupt electrical power to the dryer in the absence of adequate flow of exhaust air from the dryer or a dryer malfunction.

Figure 1:
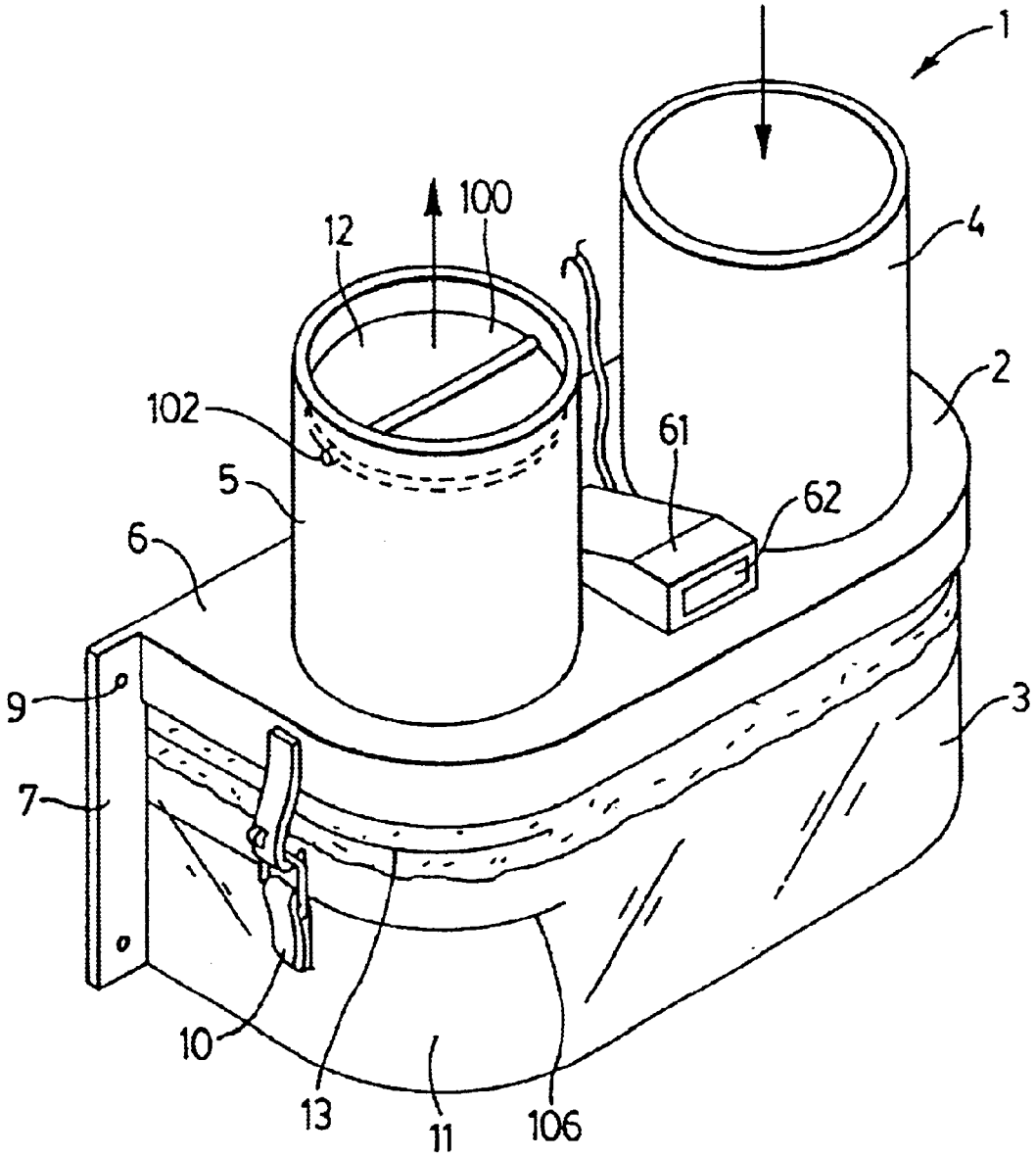
FIG. 1 is a perspective view of an appliance of the present invention adapted to be attached to a clothes dryer including a wet lint collector.

FIG. 1 shows an appliance of the present invention also referred to as a lint collector system, generally designated by 1. Lint collector system 1 has upper housing 2 and lower housing 3. Upper housing 2 has inlet 4 and outlet 5 located in upper surface 6 of upper housing 2. The diameter of each of inlet 4 and outlet 5 may be varied, but is most preferably of the same diameter as exhaust ducting passing from a clothes dryer. In particular, each of inlet 4 and outlet 5 is of a diameter consistent with the flexible corrugated hose that is used with many clothes dryers. However, it will be understood that the diameter may be varied to accommodate a lint collector system 1 into an existing exhaust system from a clothes dryer.

Upper housing 2 has a pair of horizontal wall bracket 7, which are adapted to attach the lint collector system 1 to a surface, e.g., a wall, using screw holes 9. Horizontal wall brackets are preferred, especially of a length that permits opening of closure 10, as discussed below. Vertical wall brackets could be used but would be more susceptible to inadvertent installation in an inconvenient position.

Lower housing 3 is separable from upper housing 2, and in normal use is attached to upper housing 2 by means of closure 10. It is understood that closure 10 may be of any type suitable for attachment of lower housing 3 to upper housing 2, while permitting separation of lower housing 3 from upper housing 2. As will be apparent from the discussion herein, closures 10 will be provided on opposed ends of upper housing 2, such that lower housing 3 may be detached and lowered from upper housing 2 for the purpose of emptying. As discussed herein, lower housing 3 contains water, 11, for collection of lint.

Outlet 5 is shown with flow meter 12 located therein. Flow meter 12 may be located close to or as part of lint collector system 1, being located in outlet 5 of lint collector system 1, or flow meter 12 could be located at any convenient location downstream from outlet 5. Preferably the flow meter 12 is located downstream from the lint collector, i.e. the lint collector and flow meter are located in sequence in the safety device. Flow meter 12 will not be located prior to inlet 4 as in such a location, as will be apparent from the discussion herein, flow meter 12 would become covered in lint over a period of time. If the flow meter became covered in lint, the operation of the flow meter and interruption of the electrical circuit described herein would be affected. For instance, the calibration of the flow meter would be affected. A flow meter covered in lint could cause interruption of the electrical circuit even through the flow of air was adequate and/or fail to function at all i.e. cause interruption at all times until cleaned. It is intended that flow meter 12 would measure flow of exhaust air but cause minimal restriction in the flow of exhaust air. It will be appreciated by those skilled in the art that although it is preferable for the flow meter 12 to be downstream of the lint collector system 1, it could also be upstream of the lint collector system. It would merely require more cleaning if it was upstream of the lint collector system 1.

Flow meter 12 may have a variety of forms. For instance, flow meter 12 could be in the form of flapper 100 as is shown in the drawings. The flapper 100 would cover the cross-section of the outlets and be pivotally attached to opposed sides 102 of the outlet 5. The flapper 100 would be sufficiently light in weight to be easily pivoted during flow of air. The position of the flapper 100 will range between fully opened and fully closed. If the flow of air is below a predetermined level the position of the flapper 100 will indicate that there is an inadequate flow of air and the electrical power to the dryer would be interrupted. It will be appreciated by those skilled in the art that alternate flow meters could also be used.

A water level probe 68 (shown in FIG. 2), extends down from control panel 61. Water level probe 68 is intended to detect the presence of water within lower housing 3. If water is not detected, it is intended that the electrical supply to the dryer would be interrupted until such time as water has been added to lower housing 3. The presence of an adequate water level would be indicated on control panel 61 by display 62 or indicator light 108 (shown in FIGS. 12 and 13).

Figure 2:
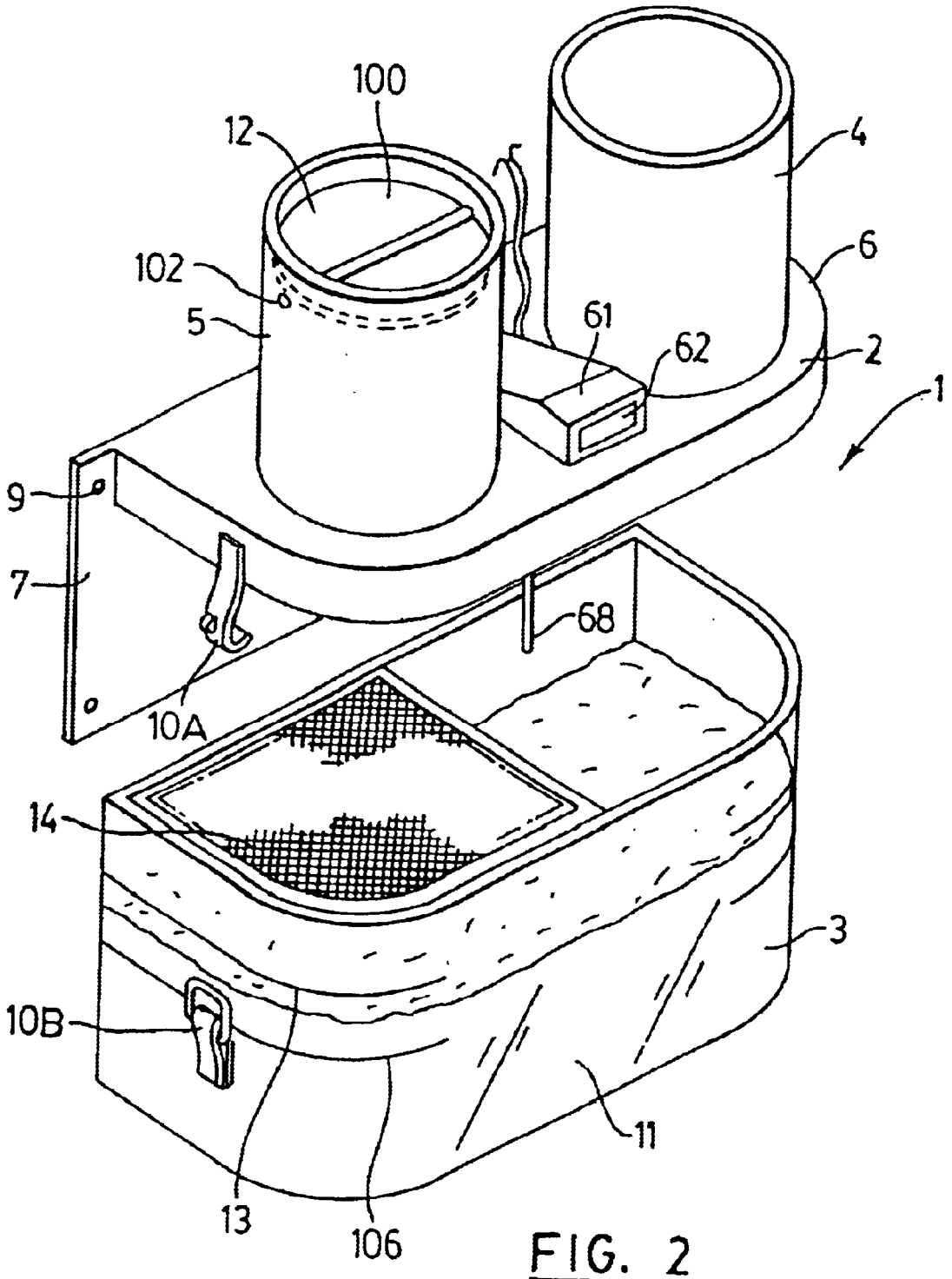
FIG. 2 is an exploded perspective view of the appliance of FIG. 1.
Figure 3:
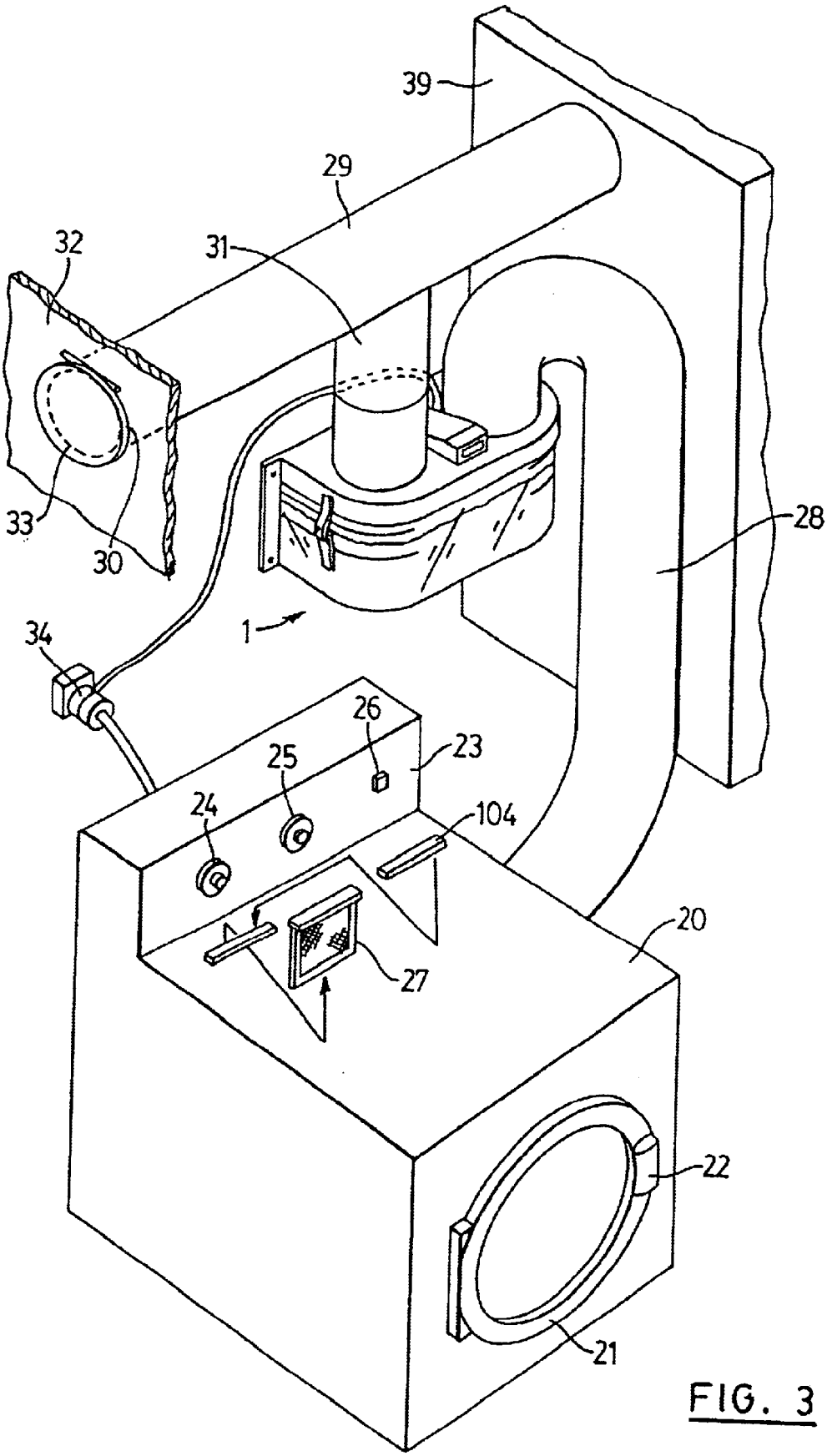
FIG. 3 is a perspective view of the appliance attached to a clothes dryer and showing a non-restricting cover plate.

FIG. 2 shows the lint collector system of FIG. 1 in an exploded or open view. Upper housing 2 would be attached to a surface, e.g., a wall, by means of wall bracket 7, using screw holes 9. It is understood that inlet 4 would be attached to a clothes dryer and outlet 5 would be attached to an exhaust system as shown in FIG. 3. Lower housing 3 has been detached from upper housing 2, by opening closure 10 shown as 10A and 10B. It is also understood that upper housing 2 would remain in its normal use position, and that lower housing 3 would be detached and removed from upper housing 2.

Lower housing 3 would be partially filled with water 11, e.g. up to water level 13. In use, the water lever may be varied, but maximum water level 13 should be at a height such that exhaust air entering inlet 4 may easily pass above water level 13 and exit through outlet 5. In preferred embodiment, water level lines could be provided to show maximum (full) water level 13 and re-fill water level 106.

Lower housing 3 is shown with optional filter 14, which is shown as being located in over generally one half of the lower housing proximate to the outlet 5. Preferably filter 14 is a fine mesh that will allow air to pass through but will catch any lint that did not touch water 11. Filter 14 is intended to facilitate drainage of lower housing 3, so that water within lower housing 3 may be poured, e.g., decanted, from lower housing 3 without substantial discharge of solid matter that may be in the water. Further, filter 14 minimizes the lint that enters outlet 5. The use of filter 14 is particularly important in buildings that include booster fans in the exhaust systems. Booster fans are most often found in multi dwelling buildings. Discharge of the entire contents of lower housing 3, i.e. a mixture of water and lint, could result in blockage of drains.

Figure 12:
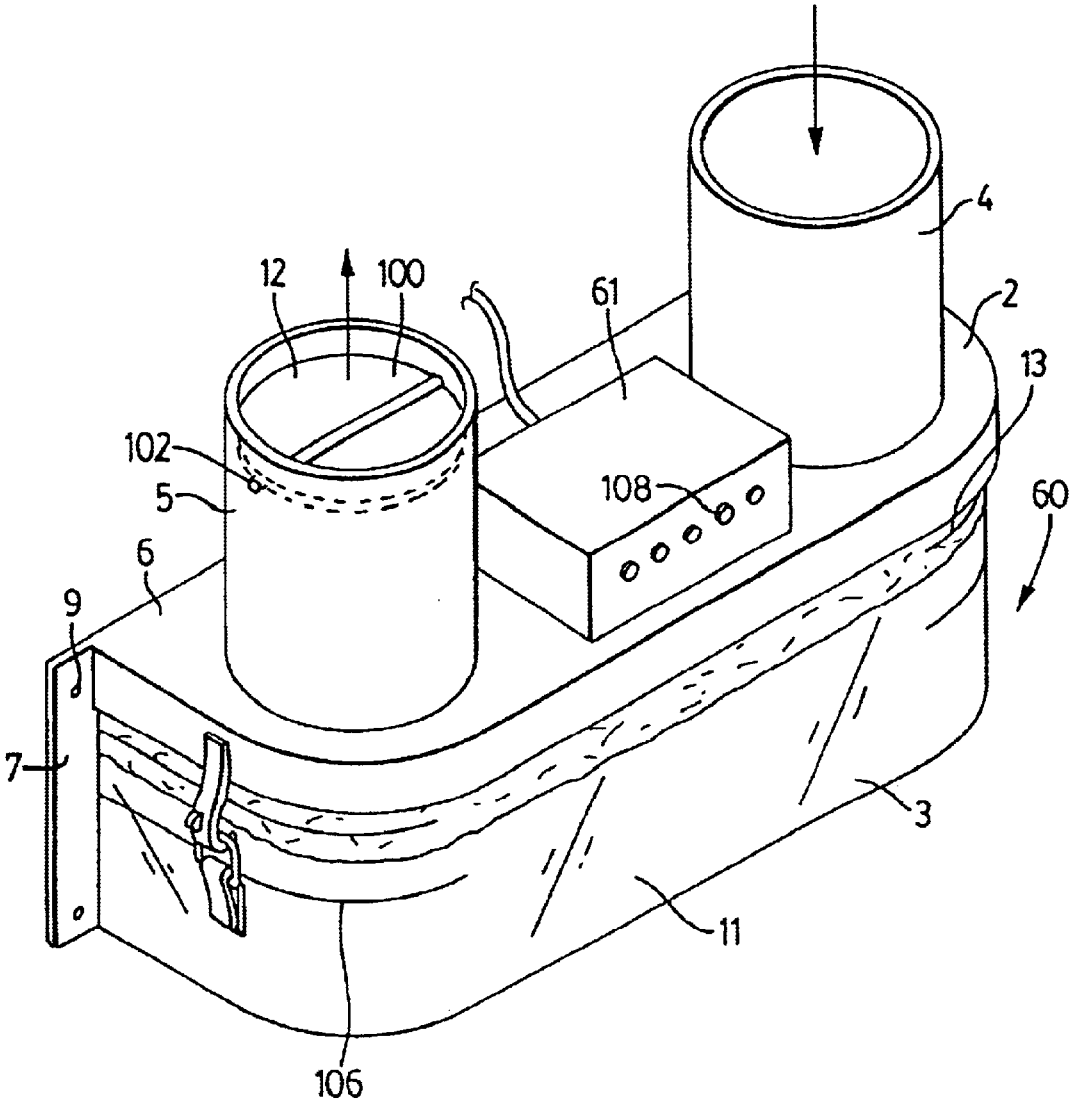
FIG. 12 is a perspective view of an alternate embodiment of an appliance of the present invention similar to that shown in FIG. 1 but with an alternate control panel.
Figure 13:
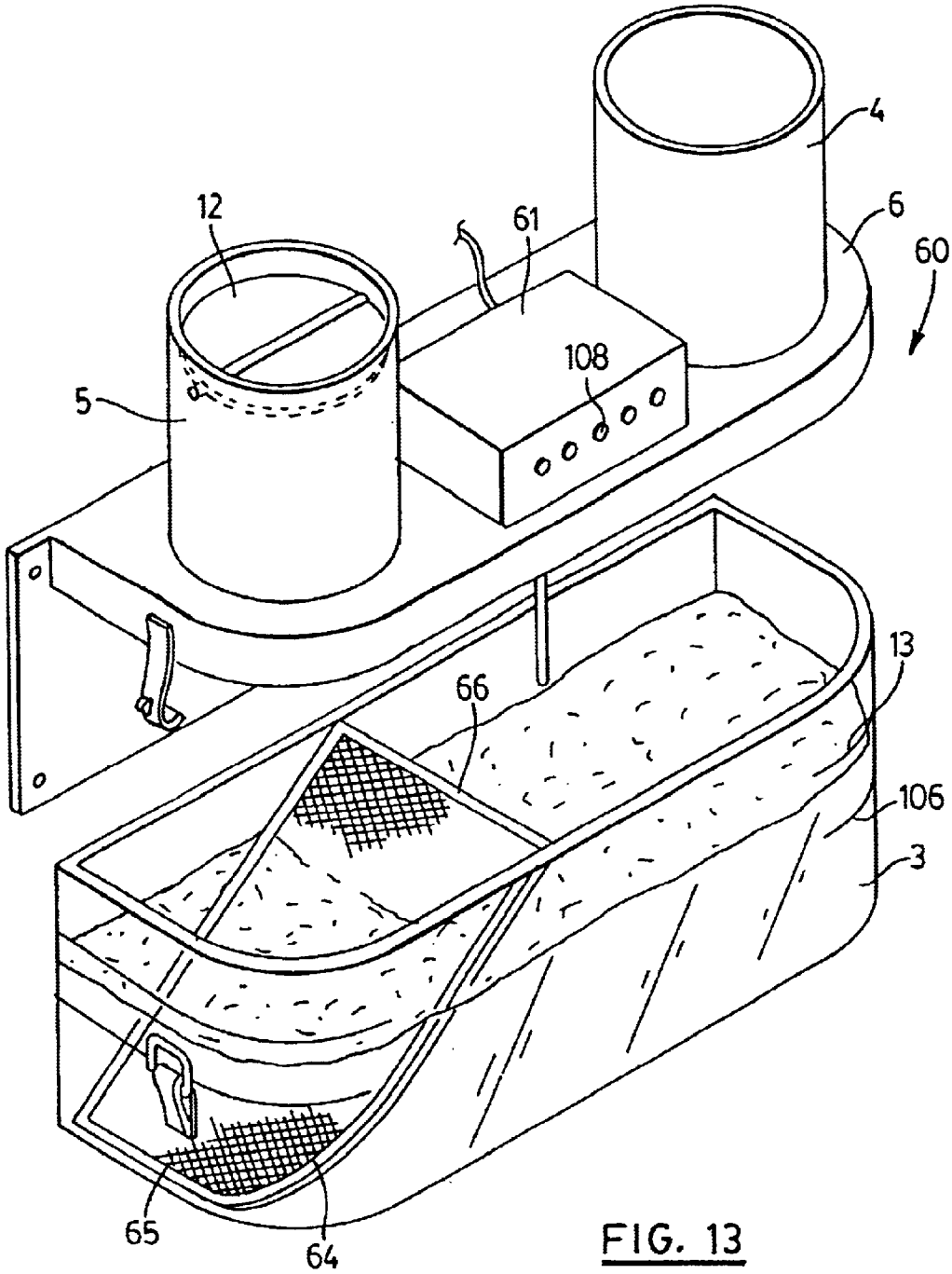
FIG. 13 is an exploded perspective view of the embodiment of FIG. 12 and showing an alternate lint.

Upper surface 6 of upper housing 2 has control panel 61 located thereon. As shown, control panel 61 has a display 62. Display 62 may be used to show information relating to a variety of functions relating to the operation of lint collector system 1. Alternatively the control panel 61 may have a plurality of indicator lights 108 as shown in FIGS. 12 and 13, depending on the functions of the lint collector system that are to be monitored. Each indicator light 108 would have appropriate identification.

In addition to the flow meter 12, lint collector system 1 may also include a number of safety features. For example as discussed above the flow meter 12 monitors the flow in the system so that if the flow drops below a predetermined level the power to the dryer is interrupted and the dryer is shut off at the source. This is described in more detail below. In addition the water level of the lint collector system 1 is monitored and if the water level drops below a predetermined level the power to the dryer is shut off. In addition the lint collector system may include a timer such that the dryer is shut off after a predetermined maximum time. Further, the lint collector system may include a temperature gage so that the dryer is shut off if the temperature is above a predetermined temperature. Preferably all of these safety features would be connected through control panel 61.

Accordingly it will be appreciated by those skilled in the art that the lint collector system 1 of the present invention may be arranged such that if the timer on the dryer malfunctions the dryer will be shut off since the dryer has run more than the predetermined time. Likewise if the dryer overheats or fails to shut off because the dryer drive belt breaks or the dryer motor malfunctions or the heating element malfunctions the dryer will be shut off since the temperature will be above the predetermined allowable temperature or beyond the maximum time allowable. Similarly if a duct pipe falls off or the duct becomes obstructed the dryer will be shut off. As discussed above the control panel 61 will indicate the type of malfunction either with the display 62 or indicator lights 108.

Figure 4:
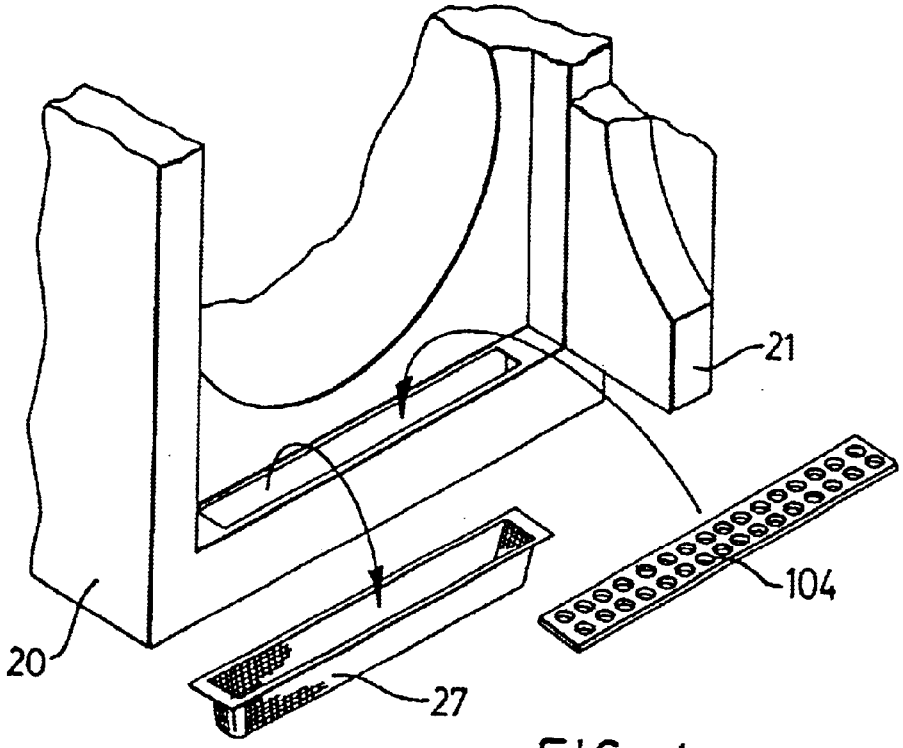
FIG. 4 is an alternate embodiment of the non-restricting cover plate.
Figure 5:
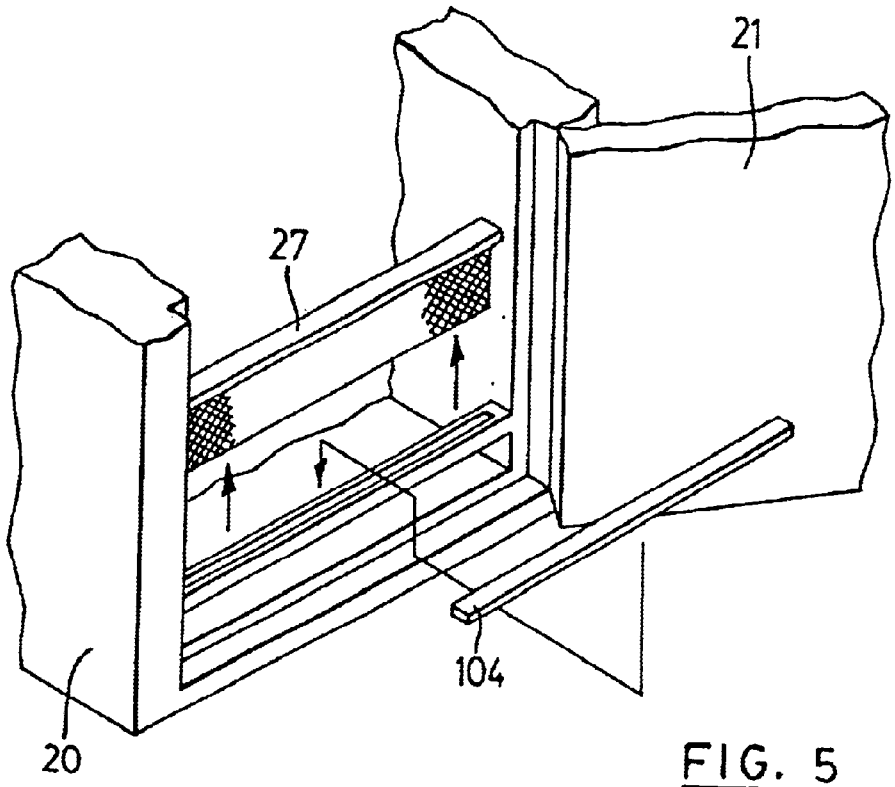
FIG. 5 is a second alternate embodiment of the non-restricting cover plate.

FIG. 3 shows a lint collector system 1 attached to a clothes dryer 20. Clothes dryer 20 has a door 21, with latch 22, for entry and removal of clothes from the drying chamber, not shown. Clothes dryer 20 has dryer control panel 23, with a temperature control 24, timer 25 and an ON/OFF switch 26. In addition, clothes dryer 20 has lint screen 27. As is known, lint screen 27 is a removable screen for initial collection of lint existing with exhaust air from the clothes dryer. Preferably lint screen 27 is removed and replaced with a non-restricting cover plate 104 (shown in FIGS. 4 and 5). Non-restricting cover plate 104 helps to maximize the lint that exits the dryer into the exhaust air tubing 29 and thus into lint collector system 1. In the embodiment illustrated in FIG. 3, lint screen 27 is on the upper surface of dryer 20, which is a common location for a lint screen. Another common location for a lint screen is immediately inside door 21 as shown in FIGS. 4 and 5. Lint screen 27 could be at other locations in dryer 20.

Exhaust air tubing 28 extends from clothes dryer 20. Exhaust air tubing 28 is connected to clothes dryer 20 as is known, and is connected at its opposed end to inlet 4 of lint collector system 1. Outlet 5 of lint collector system 1 is attached to outlet tubing 29. Outlet tubing 29 is shown as being connected to an outlet 30 in an exterior wall 32. The outlet 30 has a flap 33 to prevent air or rodents entering the outlet tubing 29. It will be appreciated by those skilled in the art that although outlet tubing 29 is shown as being attached to an outlet 30 in an exterior wall 32 it could also be vented directly into the house or multi dwelling buildings. Alternatively, outlet tubing 29 could be connected to the furnace 39 of the house or multi dwelling buildings, to supply warm moist air directly to the furnace, and thereby reduce the amount of heat that is required to heat the building. In addition, connection of outlet tubing to the furnace would supply warm moist air to the furnace, which would assist in humidifying the building, particularly in winter months in climates that would have extreme cold and dry weather. As a further alternative a Y or Tee connection 31 could be included wherein the outlet is not only connected to both the outside through exterior wall 32 as described above but also connected to the furnace 39. The Y or Tee connection 31 could have a summer setting wherein the outlet is vented outside and a winter setting wherein the outlet is vented to the furnace or inside the home.

Figure 6:
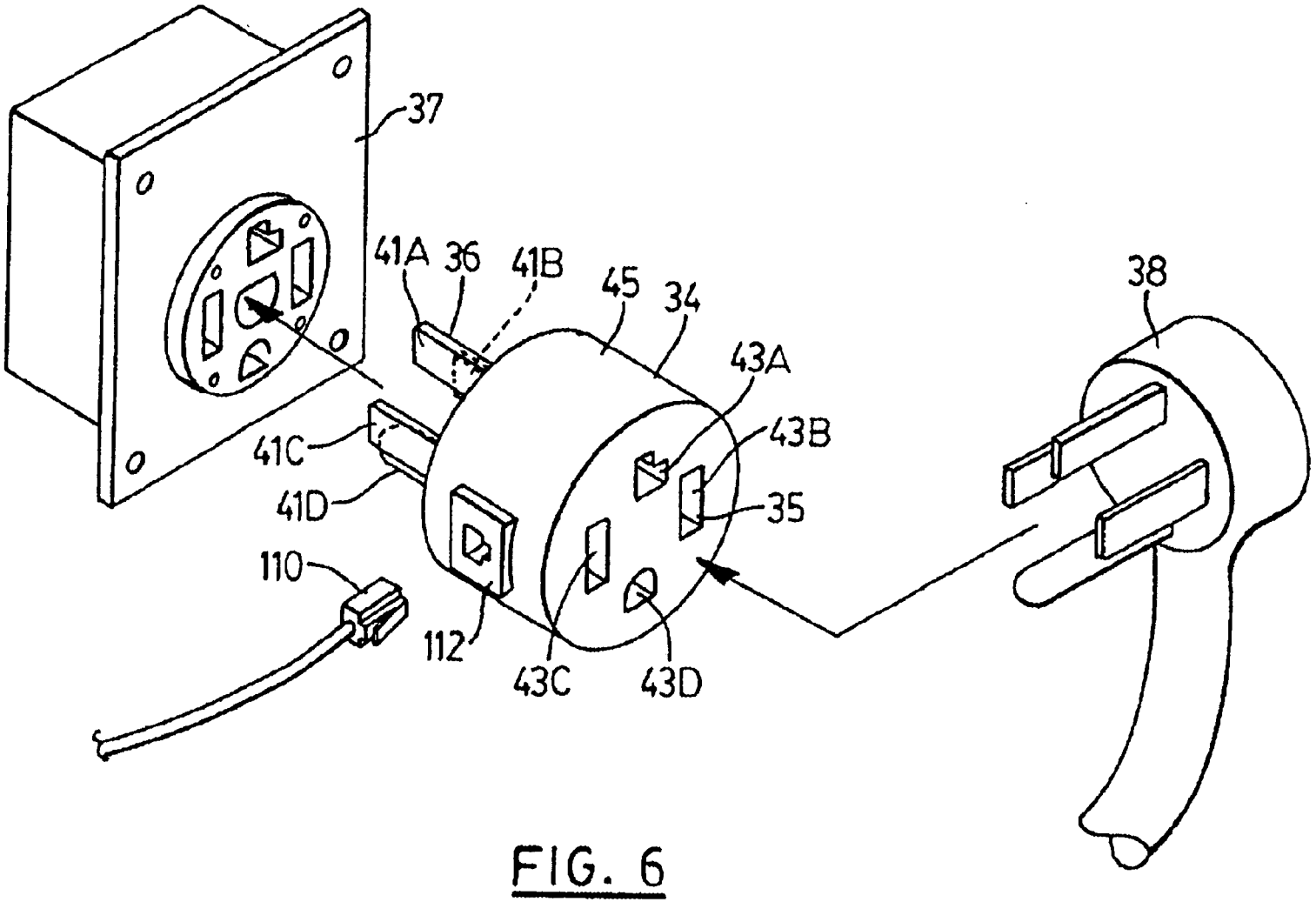
FIG. 6 is a perspective view of an adapter for the electrical supply to the dryer.
Figure 7:
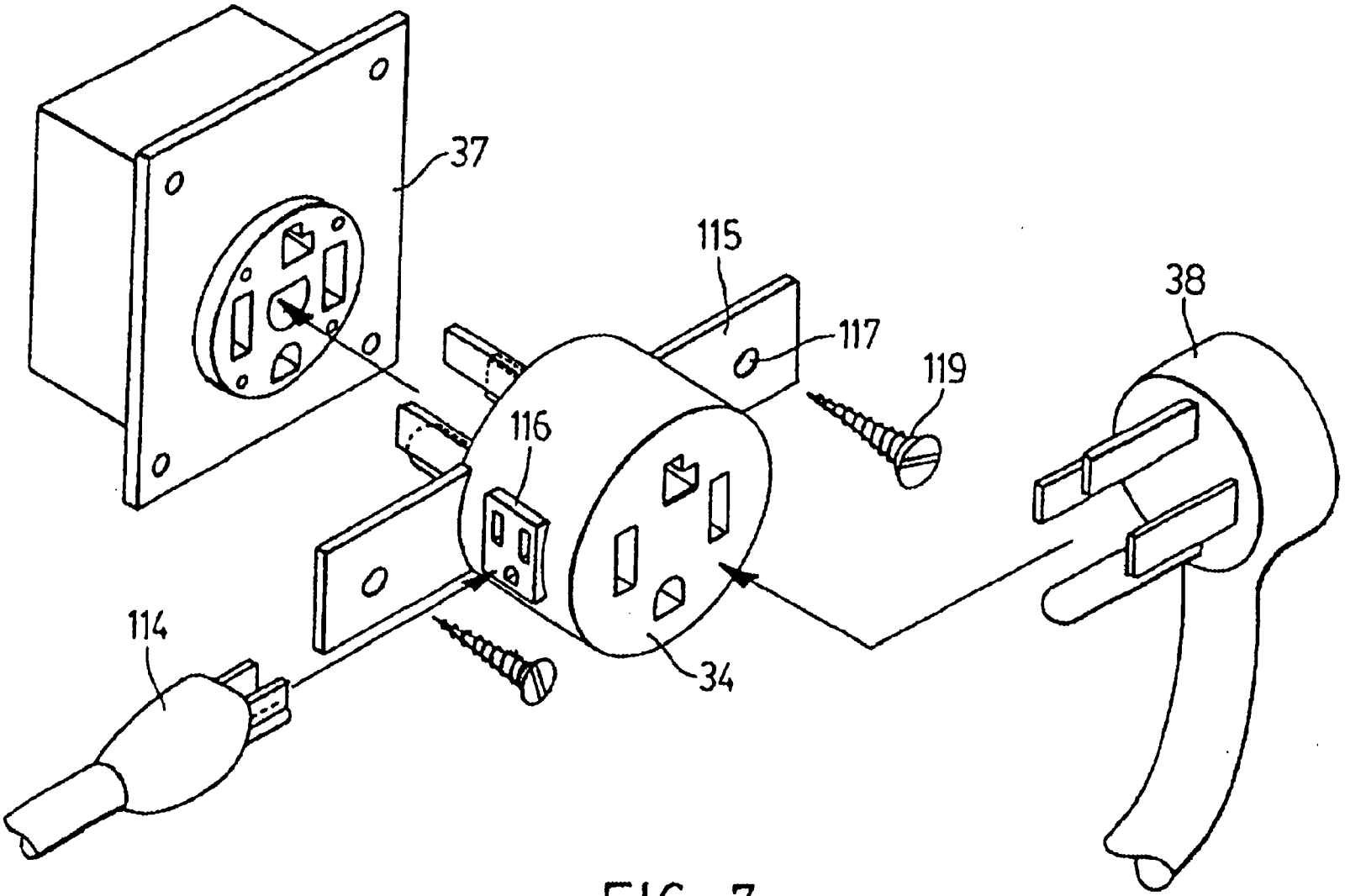
FIG. 7 is a perspective view of an alternate embodiment of an adapter for the electrical supply to the dryer.
Figure 8:
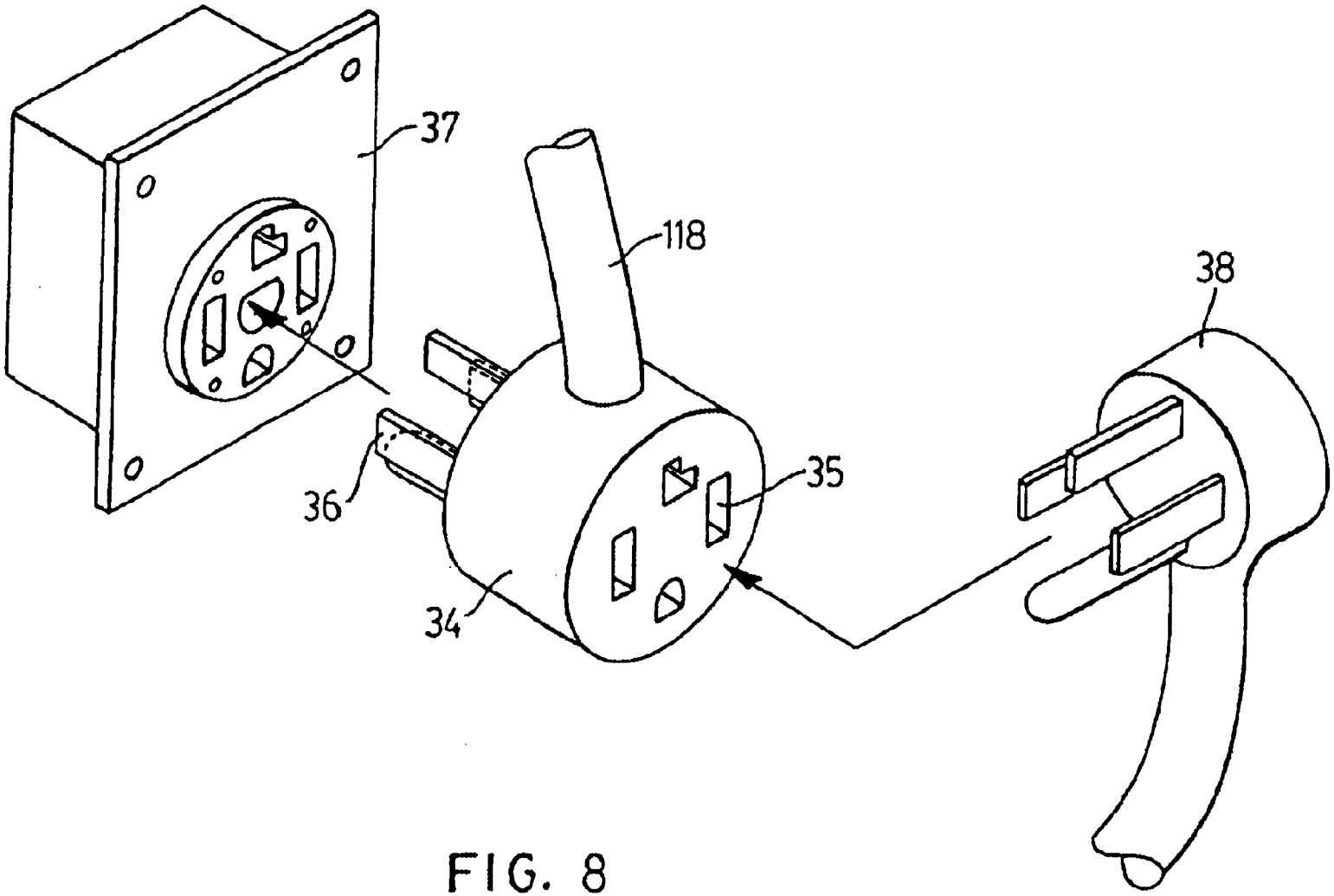
FIG. 8 is a perspective view of a second alternate embodiment of an adapter for the electrical supply to the dryer.
Figure 9:
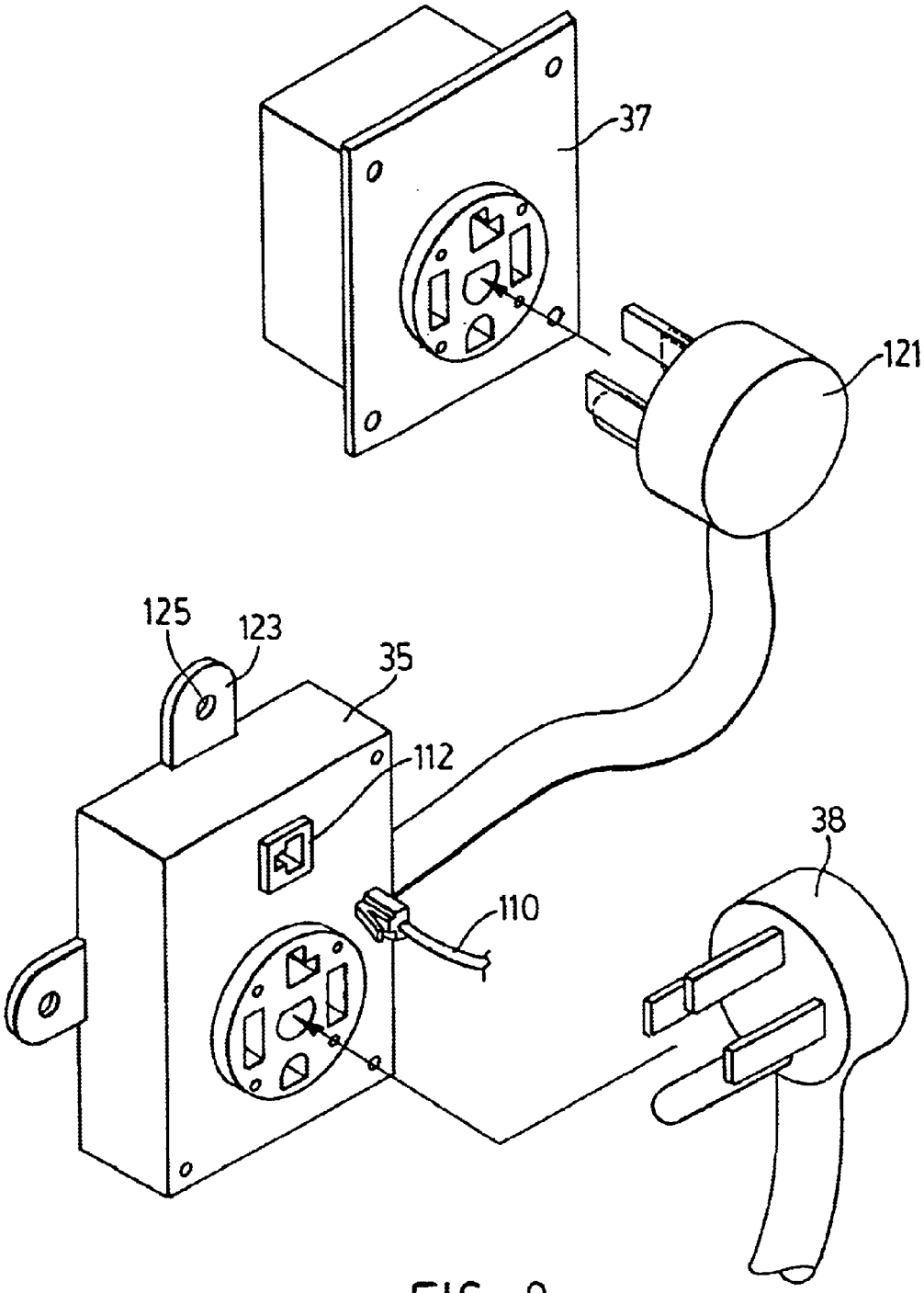
FIG. 9 is a perspective view of a third alternate embodiment of an adapter for the electrical supply to the dryer.

Referring to FIG. 8, adapter 34 includes a female portion 35 and a male portion 36. Male portion 36 is to be plugged into a conventional wall socket 37. Dryer electrical plug 38 is attachable to female portion 36. In addition lint collector system 1 is operably connected to adapter 34. A variety of different methods of connecting lint collector system 1 to adapter are shown in FIGS. 6 to 9. As shown in FIG. 6 a phone jack type connector having a male portion 110 and a female portion 112 may be used. As shown in FIG. 7 a three pronged plug type connection may be used having a male portion 114 and a female portion 116. Also shown in FIG. 7 are two flanges 115 extending outwardly from the sides of the adapter 34. Flanges 115 have holes 117 therein for receiving screws 119. This allows adapter 34 to be attached to the wall over receptacle 37. Alternatively as shown in FIG. 8 lint collector system 1 may be hard wired into adapter 34 through wire 118. Adapter 34 is intended to be inserted into the wall socket 37 used for the clothes dryer, following which the electrical connection from the clothes dryer 38 would be plugged into the adapter. FIG. 9 shows a further alternative of adapter 34 which is adapted to be attached to the wall and is provided with a female portion 35 for receiving dryer electrical plug 38 and a plug 121 for attachment to wall socket 37. A plurality of flanges 123 with holes 125 therein extend outwardly from the adapter 34 to be attached to a wall. As discussed above a variety of methods of connecting the lint collector system 1 to the adapter may be used and one such connection is shown in FIG. 9 wherein a phone jack type connector 112 is used. It will be appreciated by those skilled in the art that the flanges may have a variety of different shapes.

Referring to FIG. 6, adapter 34 is shown with four prongs, 41A–41D. Adapter 34 has corresponding receptacles 43A–43D in housing 45 for receipt of the plug attached to the dryer. Electrical lead 36 extends from housing 45 of adapter 34 to the control panel either directly or through intermediate connections.

Housing 45 would contain a relay (not shown) or other electrical disconnect system that would effect a disruption of power between plugs 41A–41D and plug receptacles 43A–43D. The electrical disconnect system is preferably adapted to effect disruption of electrical power if the control panel is disconnected from adapter 34. Similarly the electrical disconnect system is preferably adapted to effect disruption of electrical power if other indicators are above the predetermined levels including the dryer has been in operation longer than the predetermined time, the temperature is above a predetermined value or the water is below the minimum indicator.

Figure 10:
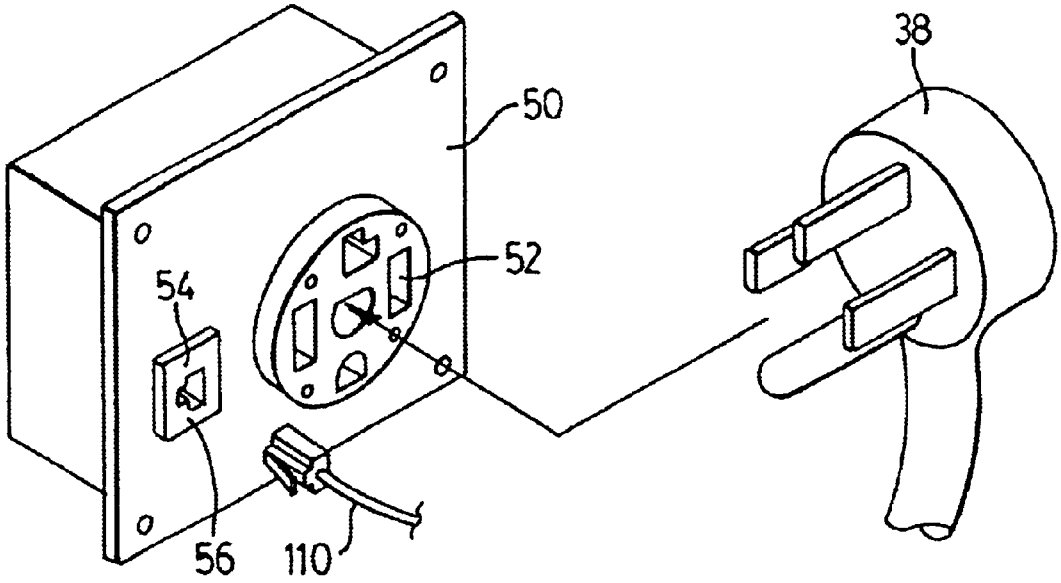
FIG. 10 is a perspective view of an alternate embodiment of a receptacle for the electrical supply to the dryer.
Figure 11:
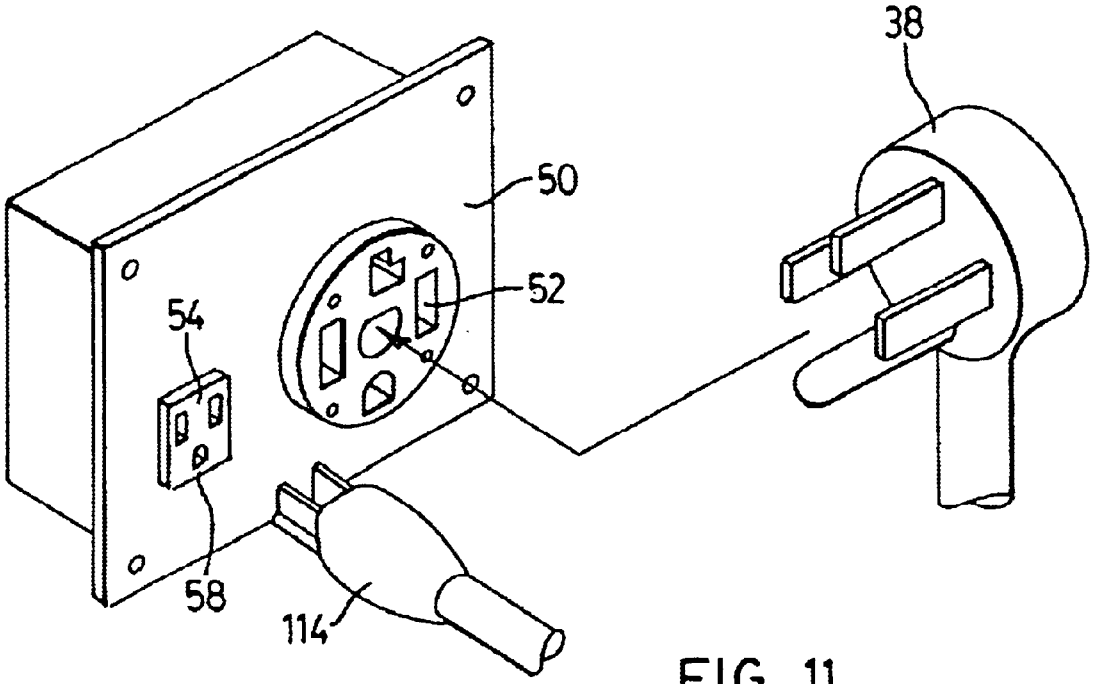
FIG. 11 is a perspective view of an alternate embodiment of a receptacle for the electrical supply to the dryer.

Referring to FIGS. 10 and 11 it is further preferred that adapter 34 be incorporated into the wall socket 37 of FIGS. 6 to 9 which is used for the clothes dryer as an integral part of a modified wall socket 50. This would prevent circumvention of the safety system of the present invention by removal of adapter 34. Accordingly modified wall socket 50 includes a dryer type socket portion 52 and a connection for lint collector system socket portion 54. In FIG. 10 a phone connector type socket 56 is shown and in FIG. 11 a three pronged plug type socket 58 is shown. In both instances lint collector system socket portion 54 and dryer type socket portion 52 are connected such that socket 50 contains a relay or other electrical disconnect system that would effect a disruption of power to dryer type socket portion 52.

In operation, lint is created during the drying process and is exhausted through the exhaust air tubing 28 and into the inlet 4 of lint collector system 1. Preferably the clothes dryer 20 does not include a lint collector. Accordingly, if it is an old style dryer with an internal lint collector the internal lint collector is disabled with a non-restricting cover plate 104. A variety of lint collector inserts are shown in FIGS. 3 to 5. It will be appreciated by those skilled in the art that the lint collector system 1 could also be used in addition to a conventional dryer with a lint collector therein. However, preferably it is used with a dryer with no internal lint collector or a disabled lint collector.

The exhaust air passing through inlet 4 is directed onto the surface of water 11. The lint that is in the exhaust air contacts and remains on the surface of water 11 and eventually it becomes waterlogged and falls to the bottom of the water in lower housing 3. The exhaust air, then free of lint, passes along the surface of the water 11 and out of outlet 5 of lint collector system 1. As is illustrated in Examples below, the exhaust air passing out of outlet 5 is generally free of lint. It is for this reason that the exhaust air may be vented directly into the home or through a furnace used to heat the home. Alternatively, the exhaust air may be vented directly outside. Any screen that is located in external wall 32 would not become clogged with lint, and thus would permit passage of air.

In the event that a screen, located between the drying chamber of clothes dryer 20 and exhausting of air from the building or through the furnace, should become clogged, the flow of exhaust air through exhaust air tubing 28 will be decreased. This will most typically occur when lint screen 27 becomes clogged with lint, and has not been cleaned. However, there are a number of other reasons that the flow may be reduced. The flow of air passing through exhaust air tubing 28 is measured by flow meter 12 located in outlet 5 of lint collector system 1. Flow meter 12 is set to record the flow of exhaust air, and would normally record whether or not the flow of air was above or below a preset level. If the flow of air was above the preset level, the clothes dryer would continue to operate. However, if the flow meter 12 detects that the flow of air falls below the preset levels flow meter 12 causes electrical interruption in the electrical supply to clothes dryer 20. The flow meter 12 may be connected through control panel 61. For instance, flow meter could cause an electrical interruption by means of adapter 34. If, subsequent to an interruption of electrical supply, obstruction is removed such that there is now an adequate flow of exhaust air through exhaust air tubing 28, the operator of the dryer would push switch 26 to re-start the dryer. Flow meter 12 would detect the adequate flow of air and the dryer would remain in operation. However, if the operator pushed switch 26 to re-start the dryer without having cleared the obstruction, there would still be an inadequate flow of air and there would be an immediate interruption of electrical supply and clothes dryer 20 would not function.

Lint collector system 1 would be located at a convenient location, typically close to the clothes dryer and substantially at eye level. Preferably lower housing 3 is transparent, so that an operator would be able to observe the quantity of lint that has collected in water 11. Alternatively, the lower housing could be an opaque material. The water in lower housing 3 may be replaced after disconnecting lower housing 3 from upper housing 2, pouring water down that drain and solid matter into a garbage container. It is to be expected that an operator would normally clean lower housing 3 more frequently than would be necessary for operation of lint collector system 1, as the appearance of the water in lower housing 3 would likely indicate that the water should be changed before it is essential to do so.

Figure 14:
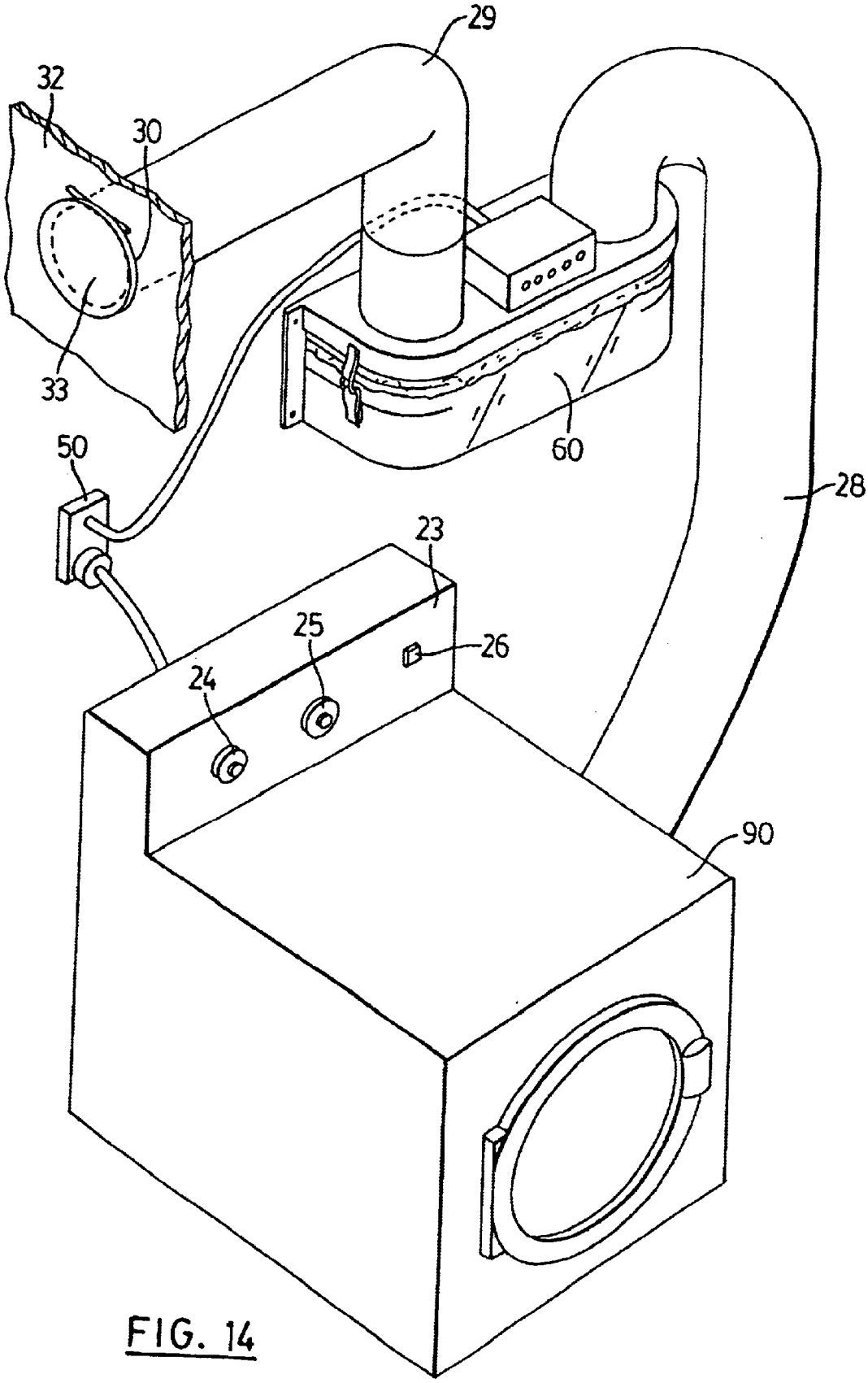
FIG. 14 is a perspective view of the appliance of FIG. 12 attached to a clothes dryer and the receptacle of FIG. 10.

Referring to FIGS. 12 to 14 an alternate lint collector system 60 is shown with larger dimensions than lint collector system 1. It is to be understood that the dimensions of the lint collector system, and especially the dimensions of upper housing 2 and lower housing 3 may be varied. Examples of dimensions of the lint collector systems are given in the examples below. However, it is found that increasing the distance between inlet 4 and outlet 5 reduces the likelihood that air entering inlet 4 will flow directly to and out of outlet 5 without lint particles entrained in the air contacting the surface of the water. Filters or screens may be placed in the lint collector system, most preferably at the junction of outlet 5 with upper surface 6 of upper housing 2 to reduce any likelihood of lamina flow of air from inlet 4 to outlet 5.

The embodiment of FIGS. 12 and 13 has a different filter 64, than the lint collector system of FIG. 1. Filter 64 is angled across on end of lower housing 3 generally from the bottom corner 65 to the middle 66 at the outlet end of the lower housing. The angled filter 64 has a similar function to filter 14. When the lint collector system 60 is in use the water therein is somewhat turbulent, this turbulence helps to keep the angled filter 64 clean, The embodiments of FIG. 14 does not show the presence of lint screen 27 illustrated in FIG. 3. In a typical clothes dryer, a lint screen 27 is located on the exhaust side of the drying chamber of the clothes dryer by a fan that is located downstream from lint screen 27. As the air is drawn into the drying chamber, this inlet air is heated to the desired temperature. Thus, air is not blown into the drying chamber, but is rather pulled through the drying chamber by a fan located downstream of the lint screen. This arrangement ensures that air is only drawn into the drying chamber at the rate at which it can be exhausted from the drying chamber. However, the presence of the lint screen in the tubing through which the air from the dryer must pass is an impediment to the flow of air, even if the lint screen 27 is completely free of lint. As the lint screen becomes covered with lint, the flow of air decreases further. Removal of the lint screen causes an increase in the flow of air in a typical dryer of approximately 50% to 100%. Such an increase in the flow of air substantially reduces the time required to dry a load of clothes. Thus, in a preferred embodiment of the present invention, an alternate dryer 90 Is shown with the lint screen removed therefrom in its entirety so that air exhausts directly from the clothes dryer without having to pass through a lint screen. Lint is removed from the exhausted air using a lint collector system of the type described herein. Thus, a preferred embodiment of the present invention provides a dryer and lint collector system in combination, without a lint screen, i.e. the lint screen of the dryer is replaced with a lint collector system described herein. FIG. 14 shows a wall outlet 50 that would be particularly used with a new home installation. However, it will be appreciated by those skilled in the art that dryer 90 could also be used with adapter 34 if new outlet 50 is not being installed in the home.

Figure 15:
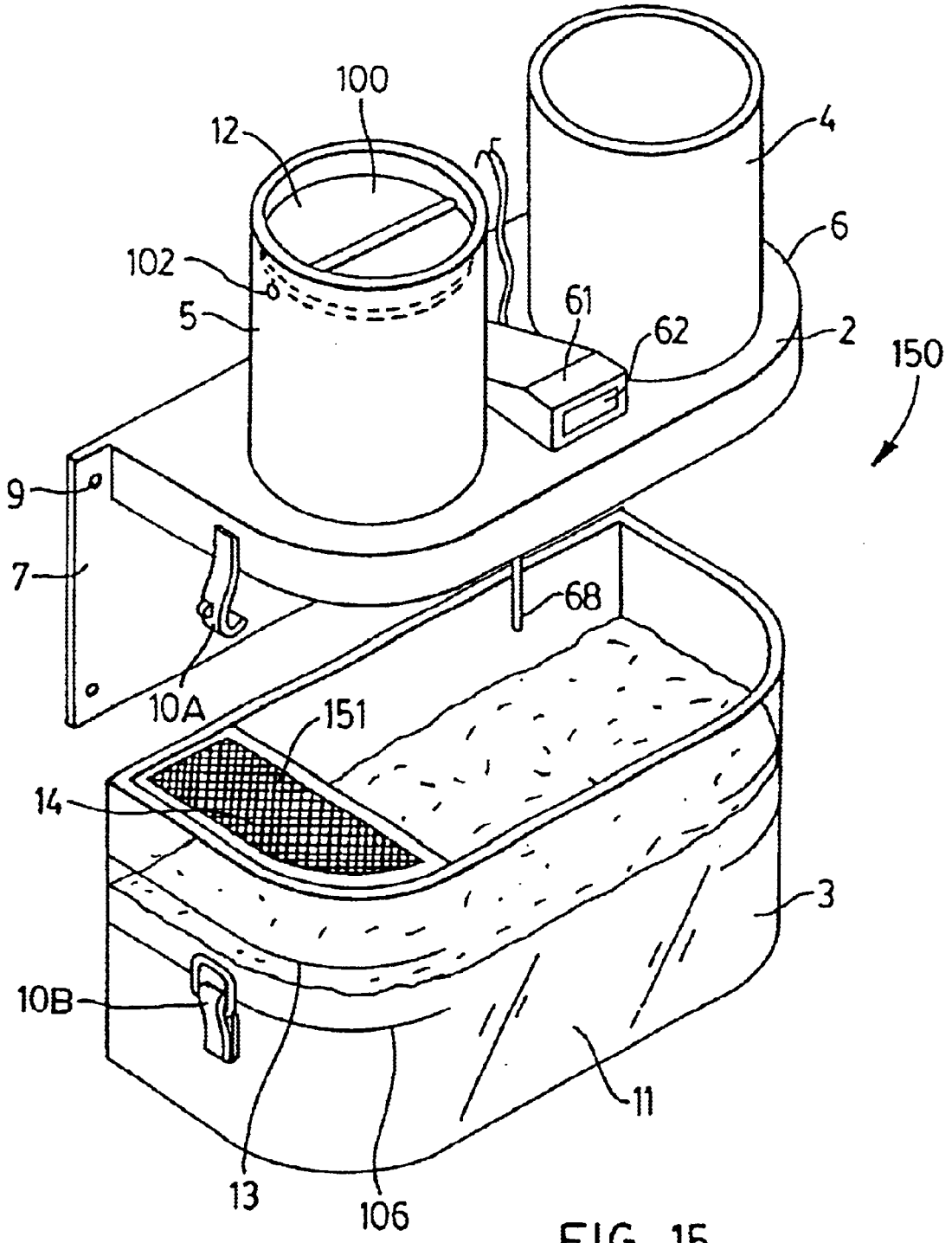
FIG. 15 is an exploded perspective view of a second alternate embodiment of an appliance of the present invention similar to that shown in FIG. 2 but with a sieve.

Referring to FIG. 15 a lint collector system is shown at 150 which is similar to that shown in FIGS. 1 and 2. Lint collector system 150 includes a smaller sieve 151. In installations that include no booster fan a smaller sieve such as that shown herein may be used. In all other aspects it is the same as that described above with regard to lint collector system 1. This lint collector system is of particular use with dryers that include a lint screen. It has been observed lint screens in many dryers still allow a certain amount of lint into the dryer outlet therefore the lint collector system herein may still be used with such dryers and in those instances a large sieve need not be used in the lint collector system 150. However it should be noted that a dryer and lint collector system that does not include a lint screen inside the dryer is generally more efficient.

The lint collector system of FIGS. 12–14 and that of FIG. 15 would be operated in the same manner as described above for FIGS. 1–3.

The safety system of the present invention is intended to collect lint from the dryer and to effect a disruption of electrical power in the event that the flow of exhaust air decreases below a pre-set limit or dryer malfunction due to mechanical failure. This will improve dryer efficiency by maintaining an adequate flow of exhaust air, and reduce the likelihood of fires due to a plugged exhaust line, overheated dryer or the like. While improvements in dryer efficiency are important from an economic point of view, the reduction in fires and consequent reduced potential for loss of life is of a prime importance. The system also permits exhaustion of air external to the building or recycling of clean moist air through a heating furnace, as both a savings in heating costs and an increase in humidity. The latter is important in dry climates. It is not intended that the exhaust air subsequent to the flow meter be sent directly into the room in which the dryer is used, because of lack of control of temperature and humidity in the room.

Figure 16:
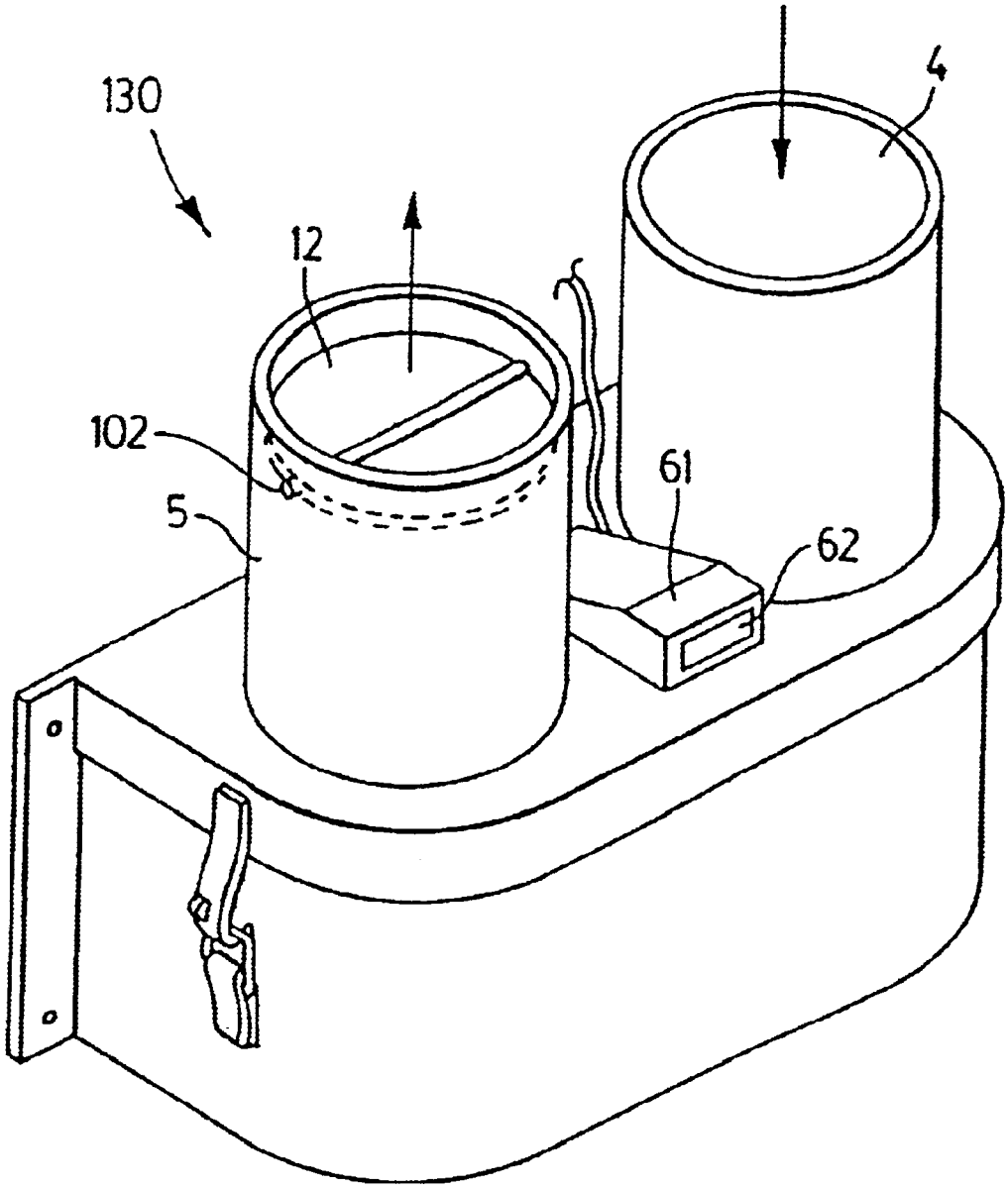
FIG. 16 is a perspective view of a safety control appliance of the present invention adapted to be attached to a clothes dryer.
Figure 17:
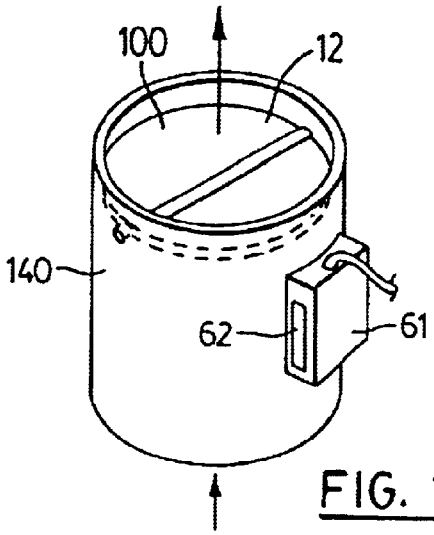
FIG. 17 is a perspective view of an alternate embodiment of a safety control appliance similar to that shown in FIG. 16 but having a different orientation.

Referring to FIGS. 16 to 20 the system may be a monitoring system. Referring to FIG. 16 the monitoring system 130 includes the flow meter 12 described above. The flow meter 12 monitors the flow in the system so that if the flow drops below a predetermined level the power to the dryer is interrupted and the dryer is shut off at the source. In addition the monitoring system 130 may include a timer such that the dryer is shut off after a predetermined maximum time. Further, the monitoring system 130 may include a temperature gage so that the dryer is shut off if the temperature is above a predetermined temperature. An alternate embodiment of a monitoring system 140 is shown in FIG. 17. This system could have all of the features of system 130. As above these safety features would be connected through the control panel 61

Figure 18:
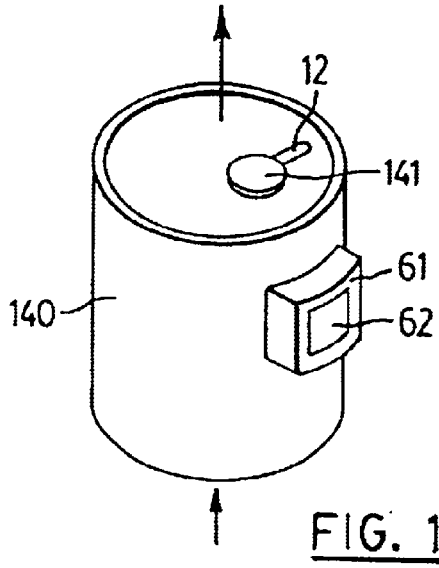
FIG. 18 is a perspective view of a second alternate embodiment of a safety control appliance similar to that shown in FIG. 17 but having a vane type flow meter.
Figure 19:
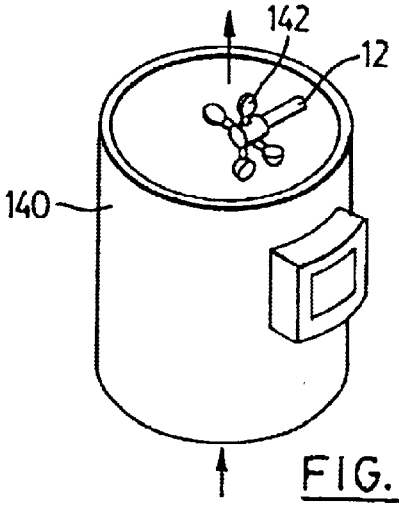
FIG. 19 is a perspective view of a second alternate embodiment of a safety control appliance similar to that shown in FIG. 17 but having a propellor type flow meter.
Figure 20:
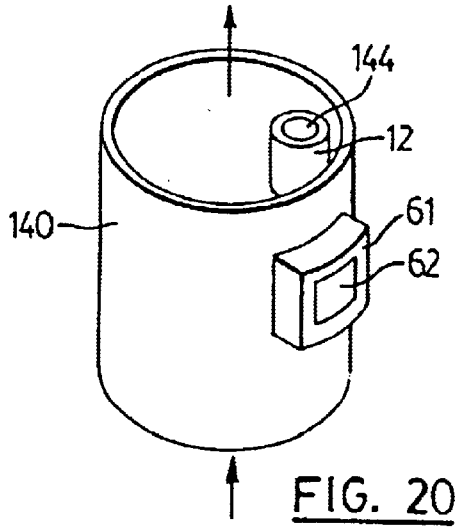
FIG. 20 is a perspective view of a second alternate embodiment of a safety control appliance similar to that shown in FIG. 17 but having a pressure sensor/switch type flow meter.

It will be appreciated by those skilled in the art that there are a number of flow meters 12 that could be used in regard to any of the above systems. A few such flow meters are shown in FIGS. 17 to 20 with regard to the monitoring system 140 but it will be appreciated that these are by way of example only and that any system for measuring the flow of air in a pipe is contemplated by the inventors herein. FIG. 18 shows a vane type flow meter 141. FIG. 19 shows a propellor type flow meter 142. FIG. 20 shows a pressure sensor/switch type flow meter 144.

Figure 21:
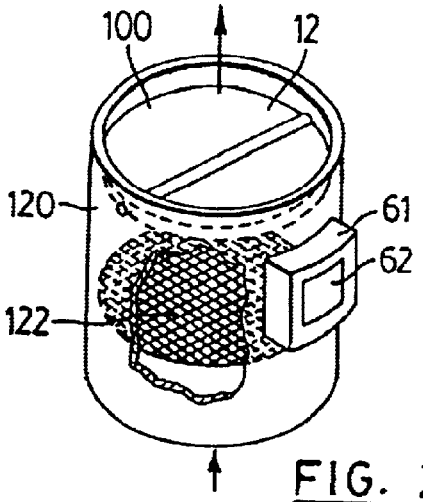
FIG. 21 is a perspective view of an appliance of the present invention adapted to be attached to a clothes dryer including an dryer outlet flow meter and a dry lint handling system.

It will be appreciated by those skilled in the art that there are number of alternate embodiments that may be employed while still achieving the above benefits. For example as shown in FIG. 21 lint handling system 120 may be modified such that it "electrocutes" the lint passing therethrough. Lint handling system 120 includes an electrical field through which the lint is passed. As described above lint collector system 120 includes an inlet 4 and an outlet 5 with a flow meter 12 therein. In addition lint handling system 120 may also include the other monitoring features described above with the exception of the water level indicator.

Figure 22:
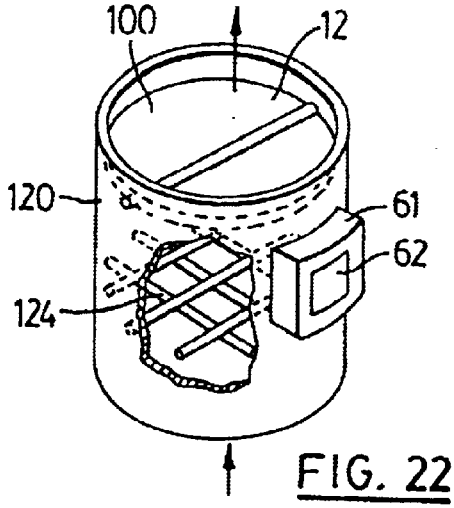
FIG. 22 is a perspective view of an alternate embodiment of an appliance similar to that shown in FIG. 21 but showing a different means of obtaining an electrical field.

The electrical field may be created in a variety of ways. For example as shown in FIG. 21 a screen 122 that extends across the pipe. Screen 122 is operably connected to a power source such that a current passes therethrough. In operation when lint passes through the electrical field it is "electrocuted". Another example is shown in FIG. 22 wherein a plurality of spaced apart wires 124 are positioned so as to create an electrical field. The spacing of the wires is depended on the voltage passed therethrough. The larger the voltage the further apart the wires may be spaced.

Figure 23:
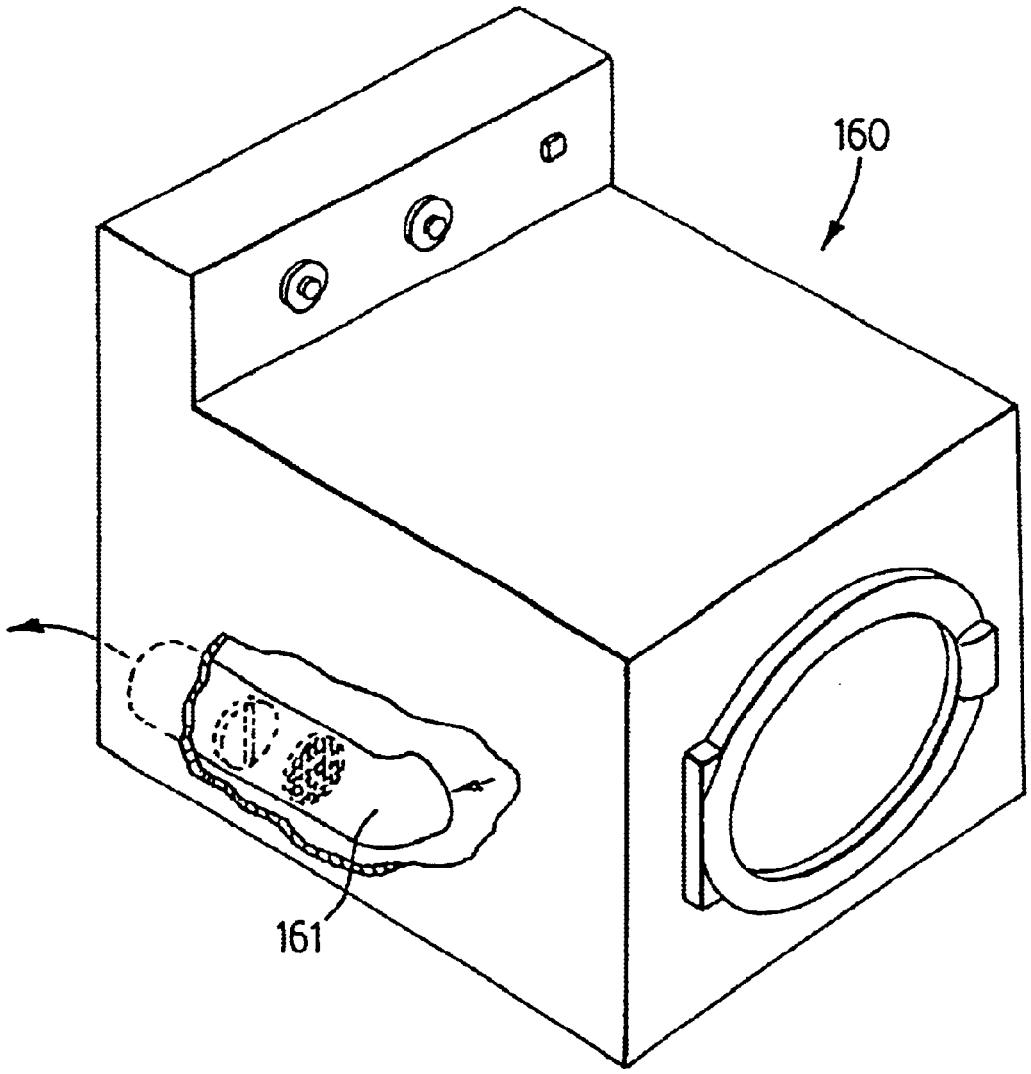
FIG. 23 is a perspective view of a dryer of the present invention including an appliance similar to that shown in FIG. 21.
Figure 24:
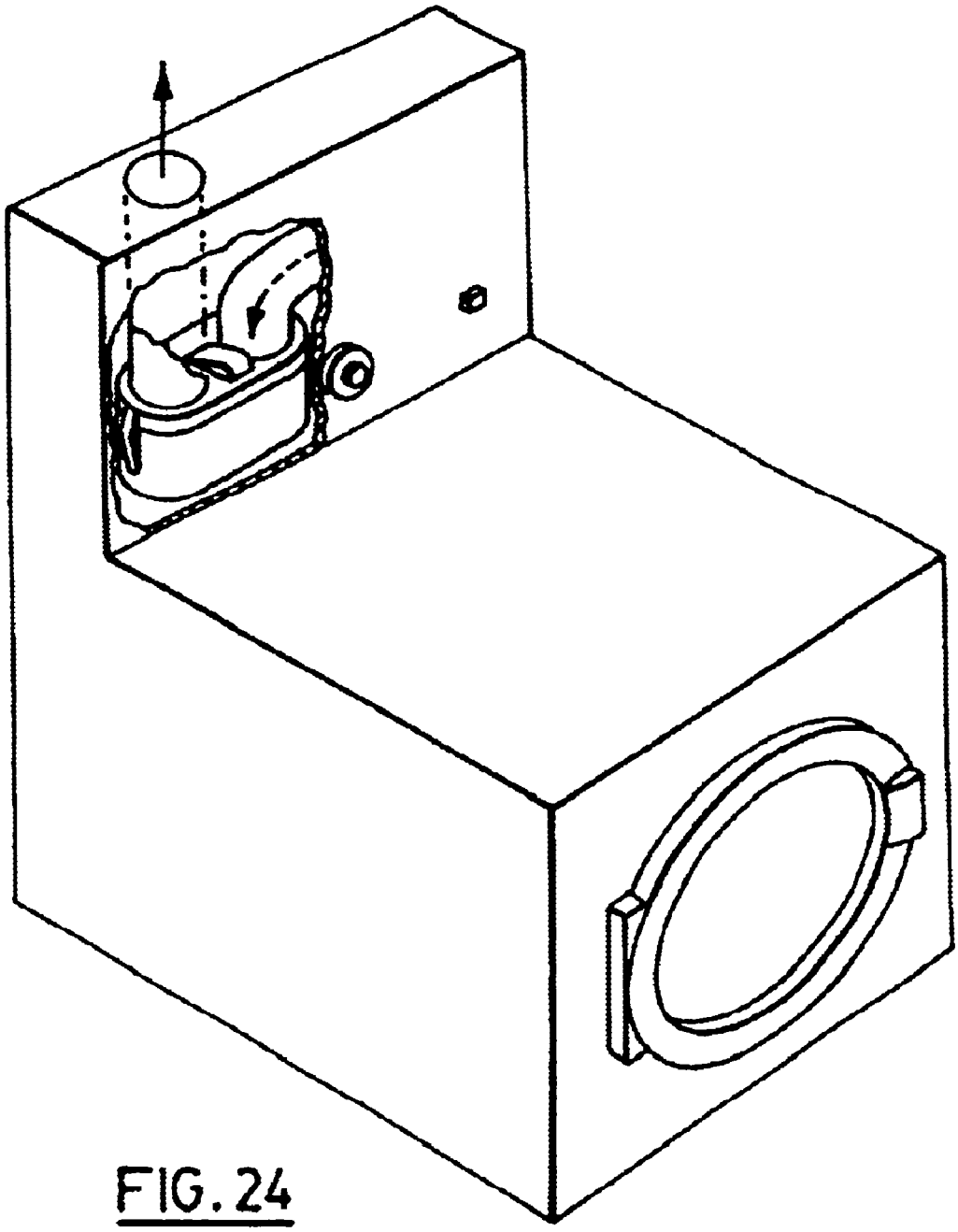
FIG 24 is a perspective view of a dryer of the present invention including a wet lint collector of the present invention.

Referring to FIG. 23 a dryer 160 is shown which includes an internal lint handling system 161. The internal handling system 161 has all of the features of lint handling system 120 but it inside the dryer 160. Similarly it may have all of the safety features described above in regard to monitoring the flow of the exhaust air, the time that the dryer is in use and the temperature of the exhaust air. As discussed above a system to interrupt electrical power to the dryer would also be included and this may be done either externally as discussed above or internally.

Accordingly it will be appreciated by those skilled in the art that the lint collector systems 1, 60, 150, lint "electrocuter" system 120 and monitoring systems 130 and 140 of the present invention may be arranged such that if the timer on the dryer malfunctions the dryer will be shut off since the dryer has run more than the predetermined time. Likewise if the dryer overheats or fails to shut off because the dryer drive belt breaks or the dryer motor malfunctions or the heating element malfunctions the dryer will be shut off since the temperature will be above the predetermined allowable temperature or beyond the maximum time allowable. Similarly if a duct pipe falls off or the duct becomes obstructed the dryer will be shut off. As discussed above the control panel 61 will indicate the type of malfunction either with the display 62 or indicator lights 108.

It will be appreciated that the above description related to the invention by way of example only. Many variations on the invention will be obvious to those skilled in the art and such obvious variations are within the scope of the invention as described herein whether or not expressly described.

The present invention is illustrated by the following examples.

EXAMPLE 1

A lint collector system as illustrated in FIGS. 1 and 2 was attached to the exhaust of a dryer, as illustrated in FIG. 3. The lint collector system was partially filled with water.

The internal dimensions of lower housing 3 of the lint collector system of FIG. 1 were approximately 10 cm in height, 15 cm in depth and 35 cm in length.

The dryer was operated in the normal drying of household laundry. It was found that lint that passed the lint collector screen of the dryer contacted the water in the lint collector, and accumulated in the water. The accumulated water collected in the bottom of the lint collector. From time to time, e.g. after a number of loads of laundry had been dried, the lower housing of the lint collector was detached. Water was drained from the housing and the remaining mass of lint was easily removed and placed in the garbage. Subsequently, the lower housing was rinsed and the water was replenished. The lower housing was re-attached to the upper housing for further use.

In a further test, adhesive tape was placed in the outlet 5 of the lint collector. It was found that no lint accumulated to the adhesive tape, i.e. all lint was removed by the water.

EXAMPLE II

The procedure of Example 1 was repeated, except that the housing did not contain water. Three different types of filters were placed in the housing and attached to inlet 4 such that all exhaust air had to pass through the filters.

The filters tested were a nylon stocking, a paint strainer and a vacuum cleaner bag. In all instances, large dust (lint) particles were removed but passed through the screen. Attempts to filter out all particles resulted in logging of the filter and restricted air flow from the dryer.

EXAMPLE III

The procedure of Example 1 was repeated, except that the water was replaced with two-sided adhesive tape on the bottom of the lint collector.

The tape was effective initially in removing lint, but became covered in a layer of lint. Subsequently, the tape was in effective in removing lint.

EXAMPLE IV

A lint collector system as illustrated in FIG. 1 was attached to the exhaust system of a dryer. The internal dimensions of lower housing 3 of the lint collector system were approximately 10 cm in height, 15 cm in depth and 35 cm in length.

The dryer was operated in the normal drying of household laundry. It was found that lint that passed the dryer contacted the water in the lint collector, and accumulated in the water, as in Example 1.

However, it was found that the embodiment of Example IV was less susceptible to entrainment of lint passing from inlet 4 to outlet 5 of the lint collector system due to increase in air flow.

What is claimed as the invention is:

1. A lint collector and safety system for the exhaust of a clothes dryer having an electrical circuit, comprising:

a housing, said housing having an inlet and an outlet for passage of exhaust air from the dryer, said inlet being adapted for attachment to the dryer, said housing having a water reservoir and a water level sensor, said housing having a flow meter therein, said flow meter being adapted to cause an interruption in the electrical circuit of the dryer if flow of the exhaust air decreases below a pre-determined limit and said water level sensor being adapted to cause an interruption in the electrical circuit of the dryer if the water level in the water reservoir is less than a predetermined water level.

2. A lint collector and safety system as claimed in claim 1 wherein the inlet is disposed such that the exhaust air from the dryer is directed onto the surface of water in the water reservoir.

3. A safety system as claimed in claim 2 further including a filter adapted to strain the water from the lint when the water is drained from reservoir.

4. A safety system as claimed in claim 3 wherein the filter covers the lint collection system outlet.

5. A lint collector and safety system as claimed in claim 1 in which the clothes dryer is within a building and the outlet of the housing is vented exterior to the building.

6. A lint collector and safety system as claimed in claim 1 in which the clothes dryer is within a building and the outlet of the housing is connected to a heating system within the building.

7. A lint collector and safety system as claimed in claim 6 in which the housing has horizontal attachment means.

8. A lint collector and safety system as claimed in claim 1 in which the housing is adapted to be attached to a wall.

9. A lint collector and safety system as claimed in claim 1 in which electrical interruption is effected within an electrical socket into which said clothes dryer is plugged.

10. A lint collector and safety system as claimed in claim 1 in which the lint collector will remove generally all lint entering the inlet.

11. A lint collector and safety system as claimed in claim 1 wherein the flow meter includes a generally circular flapper that is pivotally attached to the outlet and generally covers the outlet.

12. A lint collector and safety system as claimed in claim 1 in which the flow meter occupies a minor portion of the cross-sectional area of the outlet.

13. A lint collector and safety system as claimed in claim 1 wherein the flow meter is a vane type flow meter.

14. A lint collector and safety system as claimed in claim 1 wherein the flow meter is a propellor type flow meter.

15. A lint collector and safety system as claimed in claim 1 wherein the flow meter is a pressure switch type flow meter.

16. A lint collector and safety system as claimed in claim 1 wherein the flow meter is electrically connected to a control panel and the interruption is effected through the control panel.

17. A lint collector and safety system as claimed in claim 1 in which the water reservoir is separable for cleaning.

18. A lint collector and safety system for the exhaust of a clothes dryer having an electrical circuit, comprising:

a housing, said housing having an inlet and an outlet for passage of exhaust air from the dryer, said inlet being adapted for attachment to the dryer, said housing having a water reservoir said housing having a flow meter therein, said flow meter being adapted to cause an interruption in the electrical circuit of the dryer if flow of the exhaust air decreases below a pre-determined limit and the flow meter is electrically connected to a control panel and the interruption is effected through the control panel and a temperature sensor is connected to the control panel and is adapted to cause an interruption in the electrical circuit of the dryer if the temperature is greater than a predetermined temperature.

19. A clothes dryer having an electrical circuit comprising:

a chamber to receive and retain clothes to be dried;

an air inlet to said chamber, said air inlet having means to heat air entering the chamber through said air inlet;

an air outlet to said chamber, said air outlet having a fan therein for withdrawal of air from the chamber; and means to feed air from said fan to a lint collector system, said lint collector system having a housing with an inlet, an outlet and a water reservoir, said inlet being disposed such that air is fed from the fan into the water reservoir and then to said outlet said water reservoir having a water level sensor and said water level sensor being adapted to cause an interruption in the electrical circuit of the dryer if the water level in the water reservoir is less than a predetermined water level.

20. A clothes dryer as claimed in claim 19 further including a flow meter in said lint collection system being adapted to cause an interruption in the electrical circuit of the dryer if flow of exhaust air decreases below a pre-determined limit.

21. In a clothes dryer having a chamber to receive and retain clothes to be dried, an air inlet to said chamber with means to heat air entering the chamber through said air inlet to a pre-determined temperature, means to control said clothes dryer, an air outlet to said chamber, a lint screen in said outlet and a fan for withdrawal of air from the chamber through said lint screen, the improvement comprising replacing said lint screen with a lint collector system having a housing with an inlet, an outlet and a water reservoir, said lint collector system being located such that air withdrawn from the chamber by the fan is passed from the fan through the inlet of the lint collector system and directed onto water in the water reservoir having a water level sensor and said water level sensor being adapted to cause an interruption in the electrical circuit of the dryer if the water level in the water reservoir is less than a predetermined water level.

22. A clothes dryer as claimed in claim 21 further including a flow meter in said tint collection system being adapted to cause an interruption in the electrical circuit of the dryer if flow of exhaust air decreases below a pre-determined limit.

23. A clothes dryer as claimed in claim 21 wherein the lint collector system is internal to the dryer.

24. A clothes dryer adapted to be connected to an external lint collection system and a power source comprising:

a chamber to receive and retain clothes to be dried;

an air inlet to said chamber, said air inlet having means to heat air entering the chamber through said air inlet;

an air outlet to said chamber, said air outlet having a fan therein for withdrawal of air from the chamber, said air outlet being substantially free of obstruction:

means to feed air directly from said fan to said external lint collector system; and the external ling collector system having a water reservoir and said water having a water level sensor and said water level sensor being adapted to cause an interruption in the connection to the power source if the water level in the water reservoir is less than a predetermined water level.

25. An electrical socket for receiving a dryer plug for a dryer and a connection to a safety system comprising:

a means for providing power to the dryer plug;

a means for providing power to the safety system;

a means for receiving signals from the safety system; and a means for interrupting power to the dryer in response to predetermined signals from the safety system and the predetermined signal is responsive to a temperature in the safety system being above a predetermined limit the predetermined signal is further responsive to a time of use being greater than a predetermined time.

26. An electrical socket as claimed in claim 25 wherein the predetermined signal is further responsive to air flow in the safety system being lower than a predetermined limit.

27. An electrical socket as claimed in claim 26 wherein the predetermined signal is further responsive to a water level in the safety system being less than a predetermined water level.

28. An electrical socket as claimed in claim 25 wherein the predetermined signal is further responsive to a water level in the safety system being less than a predetermined water level.

29. A lint collector and safety system for the exhaust of a clothes dryer having an electrical circuit, comprising:

a housing, said housing having an inlet and an outlet for passage of exhaust air from the dryer, said inlet being adapted for attachment to the dryer, said housing having a water reservoir said housing having a flow meter therein, said flow meter being adapted to cause an interruption in the electrical circuit of the dryer if flow of the exhaust air decreases below a pre-determined limit and the flow meter is electrically connected to a control panel and the interruption is effected through the control panel and a timer is connected to the control panel and is adapted to cause an interruption in the electrical circuit of the dryer if the time a water level sensor connected to the control and adapted to cause an interruption in the electrical circuit of the dryer if the water level is less than a predetermined water level of use is greater than a predetermined time.

30. A lint collector and safety system as claimed in claim 29 including a temperature sensor connected to the control panel and adapted to cause an interruption in the electrical circuit of the dryer if the temperature is greater than a predetermined temperature.

* * * * *